US010370140B2

(12) United States Patent
Bressan et al.

(10) Patent No.: US 10,370,140 B2
(45) Date of Patent: Aug. 6, 2019

(54) TAMPER-EVIDENT CONTAINER

(71) Applicant: I.G.B. S.r.l., Milan (IT)

(72) Inventors: Alessio Bressan, Varese (IT); Michel Bressan, Induno Olona (IT); Alberto Gandolla, Induno Olona (IT)

(73) Assignee: I.G.B. S.r.l., Milan (IT)

( * ) Notice: Subject to any disclaimer, the term of this patent is extended or adjusted under 35 U.S.C. 154(b) by 0 days.

(21) Appl. No.: 15/878,498

(22) Filed: Jan. 24, 2018

(65) Prior Publication Data

US 2018/0208353 A1 Jul. 26, 2018

(30) Foreign Application Priority Data

Jan. 25, 2017 (IT) ..... 102017000007743

(51) Int. Cl.
*B65D 5/54* (2006.01)
*B65D 5/66* (2006.01)
*B65D 5/02* (2006.01)

(52) U.S. Cl.
CPC ..... *B65D 5/541* (2013.01); *B65D 5/0254* (2013.01); *B65D 5/6602* (2013.01); *B65D 2101/00* (2013.01)

(58) Field of Classification Search
CPC ..... B65D 5/54; B65D 5/541; B65D 5/0254; B65D 5/6602; B65D 5/661; B65D 5/106;
(Continued)

(56) References Cited

U.S. PATENT DOCUMENTS 5,207,374 A * 5/1993 Lo Duca ..... B65D 5/0254 206/807
5,507,428 A * 4/1996 Robinson, Jr. ..... B65D 5/0254 229/102

(Continued)

FOREIGN PATENT DOCUMENTS

DE 199109325 U1 1/1992
EP 1538090 U1 6/2005

(Continued)

OTHER PUBLICATIONS

Search Report for Italian Application No. IT201700007743, dated Sep. 5, 2017, 8 pages.

*Primary Examiner* — Corey N Skurdal
(74) *Attorney, Agent, or Firm* — Fish & Richardson P.C.

(57) ABSTRACT

A tamper-evident container comprising a storage having at least one passage opening delimited by a free edge and configured to put in communication the internal volume of the storage with the external environment; the sheet material of the storage wraps at least partially on itself in order to form an overlapping zone which comprises at least one first constraining portion and one second constraining portion engaged with each other: on the second constraining portion at least one notch is defined. The container further comprises a closure system engaged at said free edge and movable with respect to the storage; the closure system being configured for defining at least one closing condition in which the system itself interdicts the communication between the internal volume of the storage and the external environment and an opening condition in which the system itself enables the communication between the internal volume and external environment.

18 Claims, 11 Drawing Sheets

(58) Field of Classification Search
CPC .... B65D 5/10; B65D 5/6608; B65D 2101/00; B65D 2101/0015; B65D 79/02
USPC ..... 229/102, 151–153, 122.32, 143; 206/807
See application file for complete search history.

(56) References Cited

U.S. PATENT DOCUMENTS

| | | | | |
|---|---|---|---|---|
| 7,717,319 | B2 * | 5/2010 | Adam | B65D 5/0254 229/102 |
| 10,189,625 | B2 * | 1/2019 | Bressan | B65D 5/0254 |
| 2003/0178335 | A1 | 9/2003 | Ichikawa et al. | |
| 2011/0180537 | A1 * | 7/2011 | Zimmermann | B65D 5/0254 220/257.2 |
| 2016/0272362 | A1 * | 9/2016 | Grajales | B65D 5/6608 |
| 2017/0361975 | A1 * | 12/2017 | Imai | B65D 5/5004 |
| 2018/0170635 | A1 * | 6/2018 | Bressan | G08B 13/126 |

FOREIGN PATENT DOCUMENTS

| | | | |
|---|---|---|---|
| WO | WO2005110868 | U1 | 11/2005 |
| WO | WO2015170203 | U1 | 11/2015 |

* cited by examiner

FIG.2
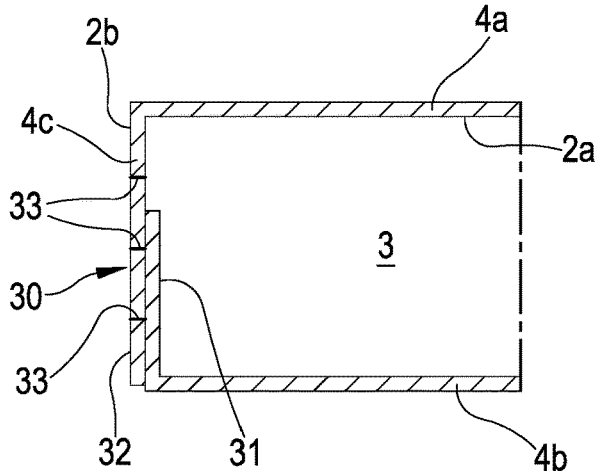
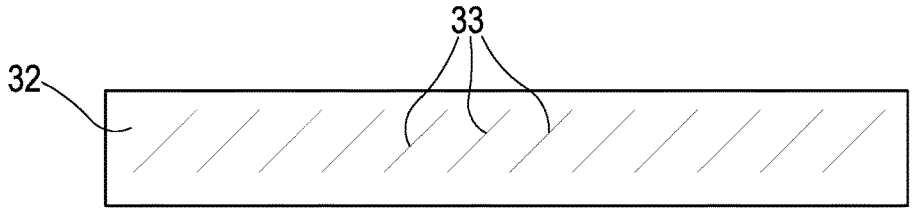
FIG.3
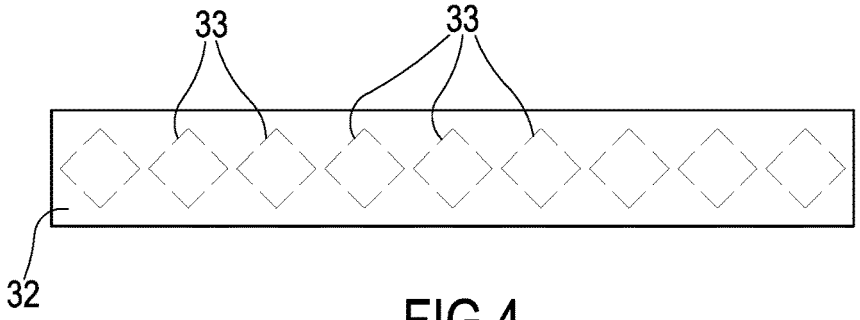
FIG.4
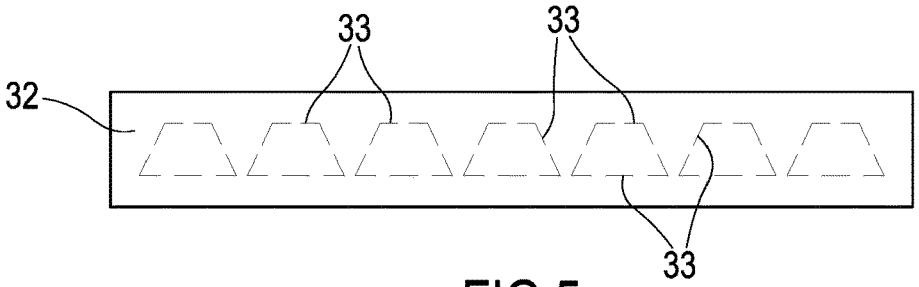
FIG.5

TAMPER-EVIDENT CONTAINER

FIELD OF THE INVENTION

The present invention relates to a tamper-evident container.

BACKGROUND

The use of containers, made of paper or plastic material, is known, equipped with safety systems to provide evidence of tampering with the container itself. These containers, also defined as "tamper-evident containers", are configured to allow the insertion of products inside them and, following a first closing condition (generally defined as a "device reinforcement" condition"), to allow the activation of a safety device so that, following a first opening condition, the container can provide evidence thereof. These systems are generally used in the pharmaceutical, cosmetic and food sectors in which it is of particular interest to guarantee the supply of intact products and in compliance with the specifications stated on the container. A first example of a tamper-evident container comprises a storage made of paper material having at least one opening for the insertion/picking of products into/from said container; the opening of the storage is delimited by a free edge at which a closure system of the container is movably engaged by rotation. The container further comprises a self-adhesive label made of printable polyester for heat transfer onto the container. The label is engaged with the closure system following the insertion of one or more products in the container and following the first closure of the container. The labels are configured to leave a clear mark on the container when removed, hence defining a "tamper-evident" safety device.

A second example of a tamper-evident container is described in US patent application US2011/0180537A1 which concerns a container entirely made of paper material having a storage provided with an opening—for the insertion and extraction of products—delimited by a free edge; at such opening there are two opposite lateral tabs rotatingly moveable around the edge. The lateral tabs are configured to rotate towards the inside of the storage and to be arranged in a partially overlapped condition. Each of said tabs is notched at the storage free edge to define a kind of moveable door. Further, the container exhibits a cover engaged with the free edge of the storage and interposed between the tabs; the cover is also rotatingly moveable around the free edge and is configured for being positioned above the tabs. Specifically, the cover carries an upper tab adapted to be overlapped on the lateral tabs to define a closed condition of the container; further the cover carries an engagement tab adapted to enter inside the container and to be locked to the lateral tabs for holding said closed condition.

The upper tab exhibits notches defining the doors, which are configured for cooperating with the respective lateral tab doors. The container provides, as a tamper-evident safety system, to forcedly fold inside the storage the upper tab and lateral tabs doors: the opening of the container causes the breakage of the doors carried by the upper tab. Thanks to the missing doors of the upper tab, the final user can detect that the container has been opened.

A third example, described in Italian patent application no. MI2014A000812 by the same Applicant comprises a container made of paper material, comprising a storage having at least one opening for the insertion/picking of products into/from said container; the opening of the storage is delimited by a free edge at which a closure system of the container is movably engaged by rotation. The container further comprises a safety device defined by a first hooking portion placed inside the storage and a second hooking portion carried by the closure system; the first and the second hooking portions are configured to be stably engaged following a first closing condition of the container ("reinforcement" condition of the container). The first hooking portion carries a removable portion which is configured to be separated from the container following a first opening condition of the latter, following the first closing condition, so as to provide evidence that the container has been tampered with.

The known containers described above are realised by the folding and gluing of a sheet of paper material; in particular, for the formation of the storage, two longitudinally opposite portions of the sheet of paper material are overlapped and glued together. Such portions could however represent an access point for the products arranged in the container that would allow the tamper-evident safety device defined by the closure system to be bypassed. Although the known containers described above are now used to define tamper-evident solutions, the Applicant has detected that the latter can however be improved in terms of various aspects.

SUMMARY

Various aspects of the invention are described here below.

In a 1st aspect, a tamper-evident container (1) is envisaged comprising:

at least one storage (2) made of sheet material defining an internal volume (3) and configured for housing products, said storage (2) having at least one passage opening (5) delimited by a free edge (6), said passage opening (5) being configured to put in communication the internal volume (3) of the storage (2) with the external environment, wherein the sheet material of the storage (2) wraps at least partially on itself in order to form an overlapping zone (30) comprising at least one first constraining portion (31) and one second constraining portion (32) engaged with each other, wherein the first constraining portion (31) defines at least part of an internal surface of the storage (2) delimiting said internal volume (3) while the second constraining portion (32) delimits at least part of an external surface of the storage (2), at least one closure system (7) made of sheet material engaged at said free edge (6) and movable, particularly by rotation, with respect to the storage (2), the closure system (7) being configured for defining at least one closing condition in which the closure system (7) itself interdicts the communication between the internal volume (3) of the storage (2) and the external environment, the closure system (7) being further configured for defining an opening condition in which the closure system (7) itself enables the communication between the internal volume (3) and external environment, wherein at least one notch (33) defining a weakening portion of the second constraining portion (32) is defined on said second constraining portion (32).

In a 2nd aspect in accordance with the 1st aspect the notch (33) passes through the second constraining portion (32).

In a 3rd aspect in accordance with any one of the preceding aspects the second constraining portion (32) of the storage (2) is made of sheet material and extends in thickness between a first and a second surface, the notch (33) extending in thickness between said first and second surface of the second constraining portion (32).

In a 4th aspect in accordance with any one of the preceding aspects, the second constraining portion (32) comprises a plurality of notches (33), in particular passing through the thickness of said second constraining portion (32).

In a 5th aspect in accordance with any one of the preceding aspects the storage (2) made of sheet material comprises at least one lateral wall (4) wrapped at least partially on itself along a longitudinal axis (A) and defining a tubular shape, said lateral wall (4)—at least partially wrapped on itself—forming said overlapping zone (30) which extends longitudinally along said axis (A).

In a 6th aspect in accordance with the previous aspect the weakening portion of the second constraining portion (32) of the overlapping zone (30) has a predetermined longitudinal extension measured along said longitudinal axis (A) of the lateral wall (4), wherein the ratio of the longitudinal extension of the weakening portion to the longitudinal extension of the lateral wall (4)—both measured along the longitudinal axis (A)—is greater than 0.3, particularly greater than 0.5, still more particularly is comprised between 0.5 and 1.

In a 7th aspect in accordance with the 5th or 6th aspect, the overlapping zone (30) extends substantially along all the longitudinal development of the lateral wall (4).

In an 8th aspect in accordance with any one of the aspects from the 5th to the 7th the weakening portion of the second constraining portion (32) extends substantially along all the longitudinal development of the lateral wall (4).

In a 9th aspect in accordance with any one of the aspects from the 5th to the 8th, the second constraining portion (32) comprises a plurality of notches (33) which are substantially defined along all the longitudinal development of the lateral wall (4).

In a 10th aspect in accordance with any one of the aspects from the 5th to the 9th, the lateral wall (4) has, along a cross-section normal to said longitudinal axis (A), a closed outline tubular shape, in particular said lateral wall defines two free edges (6).

In an 11th aspect in accordance with any one of the aspects from the 5th to the 10th the lateral wall, e.g. having a tubular shape, defines—at opposite longitudinal end edges—respective free edges (6) each of which delimits a passage opening (5) configured for establishing a communication between the internal volume (3) of the storage (2) and the external environment, wherein the container comprises, for each passage opening, a respective closure system (7), the weakening portion of the second constraining portion (32) being defined between said longitudinal edges of the lateral wall (4).

In a 12th aspect in accordance with any one of the aspects from the 5th to the 11th, the lateral wall (4) of the storage (2) comprises a front wall (4*a*) and a rear wall (4*b*) facing and parallel to each other, the front wall and rear wall being connected to each other by a first and second connecting walls (4*c*, 4*d*) also facing and parallel to each other, wherein said overlapping zone (30) is defined at least in part on said first connecting wall (4*c*).

In a 13th aspect in accordance with the previous aspect the front wall (4*a*) is distanced from the rear wall (4*b*) by said first and second connecting walls (4*c*, 4*d*), said first and second connecting walls being distanced from each other by the front and rear walls.

In a 14th aspect in accordance with the 12th or 13th aspect the closure system (7) is directly connected, particularly joined in one piece, to the rear wall (4*b*) of the storage (2).

In a 15th aspect in accordance with any one of the previous aspects, the first and the second constraining portions (31, 32) are engaged by at least one selected from the following group:

one or more glue portions (34), particularly a cold glue, one or more portions of adhesive material (34), particularly strips of adhesive material.

In a 16th aspect in accordance with the previous aspect at least part of the notch (33) of the weakening portion is defined at the second constraining portion (32) directly engaged, particularly directly glued and/or adhesived, to the first constraining portion (31).

In a 17th aspect in accordance with the 15th or 16th aspect, the glue portion and/or adhesive material portion extends substantially along the whole extension of the weakening portion.

In an 18th aspect in accordance with any one of the aspects from the 15th to the 17th, at least part of the weakening portion directly contacts one or more glue portions and/or one or more adhesive material portions.

In a 19th aspect in accordance with any one of the previous aspects the container comprises at least one safety device (12), optionally of sheet material, engaged at least partially with the storage (2) and at least partially with the closure system (7), said safety device (12) comprising at least one removable portion (15) configured for separating from at least one between said closure system (7) and storage (2) following a first opening of the closure system (7) for giving evidence of tampering with the container (1).

In a 20th aspect in accordance with the previous aspect the removable portion (15)—following a first opening of the closure system (7)—is configured for separating from at least one from among said closure system (7) and storage (2) irreversibly.

In a 21st aspect in accordance with any one of the previous aspects, the closure system (7) comprises a tab (8) having a closure portion (9) engaged with the free edge (6) of the storage (2) and movable, particularly by rotation, with respect to this latter, the tab (8) further having at least one engagement portion (10) configured for inserting, in the closing condition of the closure system (7), into the volume (3) of the storage (2).

In a 22nd aspect in accordance with the previous aspect the safety device (12) comprises:

at least one first hooking portion (13) borne by the tab (8) of the closure system (7), at least one second hooking portion (14) engaged with the storage (2) and configured for cooperating with said first hooking portion (13), the first and second hooking portions (13, 14) being configured for stably engaging with each other during a first closing condition of the closure system (7), at least one between said first and second hooking portions (13, 14) bearing said removable portion (15) which is configured for separating from the safety device (12) following a first opening of the closure system (7) after a first closure of this latter.

In a 23rd aspect in accordance with the previous aspect the second hooking portion (14) is arranged at least partially in the container (1).

In a 24th aspect in accordance with the 22nd or 23rd aspect the second hooking portion (14) is at least partially placed in the internal volume (3) of the storage (2).

In a 25th aspect in accordance with any one of the aspects from the 22nd to the 24th the second hooking portion (14) is entirely arranged in the storage (2), in particular distinct and distanced from the free edge (6) of the storage (2) itself.

In a 26th aspect in accordance with any one of the aspects from the 22nd to the 25th the first hooking portion (13), during the first closure of the system (7), is configured for inserting at least partially in the internal volume (3) of the storage (2) for stably engaging with the second hooking portion (14).

In a 27th aspect in accordance with any one of the aspects from the 22nd to the 26th the second hooking portion (14) is associated with the front wall (4*a*) of the storage (2) and is configured to receive in engagement the first hooking portion (13) associated with the closure system directly connected with the rear wall (4*b*) of the storage (2).

In a 28th aspect in accordance with any one of the aspects from the 22nd to the 27th the removable portion (15) is only borne by the second hooking portion (14) of the safety device (12).

In a 29th aspect in accordance with any one of the aspects from the 19th to the 27th, the removable portion (15) is arranged—at least during the first closure of the closure system (7)—in the internal volume of the storage (2).

In a 30th aspect in accordance with any one of the aspects from the 19th to the 28th the removable portion (15)—in the first closing condition of the closure system (7)—is entirely arranged inside the storage, in particular inside the internal volume of the storage (2), and distanced from the free edge (6) of the storage itself.

In a 31st aspect in accordance with any one of the aspects from the 22nd to the 30th the removable portion (15) of the second hooking portion (14) has at least one undercut portion (16), said first hooking portion (13) being configured to be engaged with said undercut portion (16) following the first closure of the closure system (7).

In a 32nd aspect in accordance with the previous aspect the undercut portion (16) of the removable portion (15) is delimited by a gripping edge (17) which, following the first closure of the closure system (7), is distinct and distanced from the free edge (6) of the storage (2).

In a 33rd aspect in accordance with the previous aspect, the gripping edge (17) of the removable portion (15)—in the first closing condition of the closure system (7)—is entirely arranged inside the storage, in particular said gripping edge (17) of the removable portion (15) is arranged inside the internal volume of the storage (2), and distanced from the free edge (6) of the storage itself.

In a 34th aspect in accordance with any one of the aspects from the 31st to the 33rd the undercut portion (16) of the removable portion (15) comprises at least one hook (18) defining a seat (19) whose concavity faces the opposite side with respect to the passage opening (5) of the storage (2) during the first closure of the closure system.

In a 35th aspect in accordance with any one of the aspects from the 31st to the 34th the first hooking portion (13), not having said removable portion (15), comprises at least one respective undercut portion (20) delimited by a respective gripping edge (21), said respective undercut portion (20), following the first closure of the closure system (7), being configured for engaging with the undercut portion (16) of the removable portion (15), in particular entirely inside the storage (2).

In a 36th aspect in accordance with any one of the aspects from the 19th to the 35th—during the first closing condition of the closure system (7) of the container (1)—the removable portion (15) of the second hooking portion (14) is engaged with the first hooking portion (13), said engagement between the removable portion and the first hooking portion being entirely defined inside the storage, in particular at a distance from the free edge (6).

In a 37th aspect in accordance with the 35th or 36th aspect, the gripping edge (17) of the removable portion (15), in the first closing condition of the closure system (7), is interposed between the free edge (6) of the storage (2) and the respective gripping edge (21) of the hooking portion not having the removable portion (15), in particular the first gripping edge (21) of the first hooking portion (13).

In a 38th aspect in accordance with any one of the aspects from the 19th to the 37th the storage (2) comprises at least one through control opening (24) arranged at the removable portion (15) of the safety device (12) and at the engagement portion (10) of the tab (8).

In a 39th aspect in accordance with the previous aspect, the control opening (24) is configured for:

- allowing the viewing of the removable portion (15) following the first closure of the closure system (7) and prior to the first opening of the latter; and/or
- allowing the viewing of the engagement portion (10) of the tab (8) following the first opening of the container (1) to provide evidence of any tampering with the container (1); and/or
- allowing the viewing of the engagement portion (10) of the tab (8) prior to the first closing condition of the container (1) to provide evidence of any tampering with the container (1).

In a 40th aspect in accordance with the previous aspect at least one part of the engagement portion (10) visible from the control opening (24) is different and can be distinguished from at least one part of the removable portion (15) visible from the control opening (24), the diversity between the visible parts of the engagement portion (10) and of the removable portion (15) being adapted to highlight from the outside any tampering with the container (1) following the first opening of the latter.

In a 41st aspect in accordance with any one of the aspects from the 22nd to the 40th, the first hooking portion (13) is directly connected to the engagement portion (10), particularly joined in one piece, and emerges tangentially with respect to the latter, the engagement portion (10) being interposed between the first hooking portion (13) and the closure portion (9) of the tab (8).

In a 42nd aspect in accordance with any one of the aspects from the 22nd to the 41st the second hooking portion (14) is directly connected to the lateral wall (4), optionally to the front wall (4*a*), of the storage (2) and extends substantially parallel with respect to this latter.

In a 43rd aspect in accordance with any one of the previous aspects the container (1) is made by folding starting from a single semi-finished piece (50), optionally flat, made of sheet material, in particular said semi-finished piece (50) being entirely made of paper sheet material.

In a 44th aspect is provided a process of making a tamper-evident container (1) in accordance with any one of the previous aspects.

In a 45th aspect in accordance with the previous aspect said process comprises the following steps:

- folding the first sheet (51), in particular a first flat sheet, for defining the storage (2) having at least one free edge (6) and said overlapping zone, the second constraining portion thereof having at least one notch (33) defining a weakening portion,
- engaging the first and second constraining portions (31, 32) of the overlapping zone (30),
- providing a second sheet (57), particularly a second flat sheet, adapted to define the closure system (7).

In a 46th aspect in accordance with the previous aspect the first sheet (51) comprises:

at least one first and one second portion (52, 54) interconnected by a central connecting portion (53), said central connecting portion (53) being interposed between the first and second portions (52, 54), at least one first and one second lateral connecting portion (55, 56), the first portion (52) being interposed between the first lateral connecting portion (55) and the central connecting portion (53), the second portion (54) being interposed between the second lateral connecting portion (56) and the central connecting portion (53), each of said portions (52, 53, 54, 55, 56) comprising at least two opposite longitudinal edges and two opposite terminal edges, said portions (52, 54), central connecting portion (53) and said lateral connecting portions (55, 56) being joined along the longitudinal edges and aligned along a single connecting direction, wherein the step of folding the first sheet (51) provides to wrap on itself the first sheet (51) around a longitudinal axis (A) substantially parallel to the longitudinal edges of the portions (52, 53, 54, 55, 56) of said first sheet (51), and wherein the step of engaging the first and second constraining portions (31, 32) of the overlapping zone, comprises the following sub-steps:

positioning the second lateral connecting portion (56) above the first lateral connecting portion (55), fixing, for example by gluing, said first and second lateral connecting portions (55, 56) which respectively define the first and second constraining portions (31, 32) of the overlapping zone (30).

In a 47th aspect in accordance with the previous aspect the step of engaging the first and second constraining portions (31, 32) of the overlapping zone, comprises the following sub-steps:

providing on a side of the first connecting portion (55), a predetermined quantity of glue (34), particularly cold glue, positioning the second lateral connecting portion (56) above and in contact with the first lateral connecting portion (55).

In a 48th aspect in accordance with the 46th or 47th aspect the second lateral connecting portion (56) comprises at least one notch (33) adapted to define the weakening portion of said second constraining portion (32).

In a 49th aspect in accordance with the previous aspect said notch (33) is made by means of a cutting step of the lateral connecting portion (56) of the first sheet (51), in particular the cutting step is performed on the first sheet not yet folded.

In a 50th aspect in accordance with any one of the aspects from the 45th to the 49th the second sheet (57) comprises at least one first and one second portion (58, 59) joined together in one piece, the first portion (58) of the second sheet being connected to the first sheet (51) so that said first portion (58) is interposed between the second portion (59) of the second sheet (57) and the first sheet (51), wherein the step of providing the storage (2) comprises at least the following sub-steps:

folding the portions of the first sheet (51) to form the passage opening (5) delimited by the free edge (6), joining the lateral connecting portions (55, 56), wherein the step of providing the closure system comprises at least one folding step of the first and the second portion of the second sheet for forming respectively the closure portion (9) and the engagement portion (10) of the closure system (7).

In a 51st aspect in accordance with the previous aspect the process comprises a step of providing the safety device (12) comprising the following sub-steps:

providing a third sheet (62) comprising at least one portion (63) joined in one piece to the second portion (59) of the second sheet (57), the portion (63) of the third sheet (62) emerging longitudinally from the second sheet (57) on the opposite side to the first sheet (51), said third sheet (62) being configured for defining the first hooking portion (13) of the container (1), providing a fourth sheet (64) comprising at least one portion (65) joined in one piece to the first sheet (51) and configured for defining the second hooking portion (14) of the container (1), folding the portion (65) of the fourth sheet (64) to form the second hooking portion (14) of the safety device (12) so that the latter is arranged inside the volume (3) of the storage (2), the step of providing the third and/or the fourth sheet (62, 64) envisaging a step of forming, on the respective portion (63, 65), at least one further portion (66) joined in one piece to said portion (63, 65) through a weakening line (67), said further portion being configured for defining the removable portion (15) of the container (1).

In a 52nd aspect in accordance with the previous aspect the first, second, third and fourth sheets (51, 57, 62, 64) are joined in one piece to form a single semi-finished piece (50) made of sheet material, in particular paper material, optionally flat, prior to the folding steps of said sheets (51, 57, 62, 64).

In a 53rd aspect in accordance with the 50th or 51st aspect, the step of providing the further portion (66) of the third and/or of the fourth sheet (62, 64) envisages forming at least one undercut (70) which is adapted to define the undercut portion (16) of the removable portion (15), at least one from said first and second hooking portion (13, 14) being configured, in the first closing condition of the container (1), for engaging with said undercut portion (16), and wherein the step of forming at least one of the portions (63, 65), respectively of the third and of the fourth sheet (62, 64) and not bearing said further portion (66), envisages at least the formation of an undercut (71) adapted to define the respective undercut portion (20) of the container (1) which is delimited by the respective gripping edge (21), said respective undercut portion (20), in the first closing condition of the closure system (7), being configured to be engaged with the undercut portion (16) of the removable portion (15).

In a 54th aspect in accordance with any one of the aspects from the 51st to the 53rd, the step of forming the portion (63) of the third sheet (62) envisages at least the following sub-steps:

forming, as an extension to the second portion (59) of the second sheet (57), a flat sheet substantially parallel to the second sheet (57), the extension sheet emerging from the second portion (59) on the opposite side with respect to the first portion (59) of the second sheet (57), forming an undercut (71) adapted to define the first hooking portion (13) of the container (1);

and wherein the step of forming the portion (65) of the fourth sheet (64) envisages at least the following sub-steps:

forming, as an extension to the first sheet (51), a flat sheet substantially parallel to the second sheet (57), forming on said sheet at least one undercut (70) adapted to define the second hooking portion (14) of the container (1), forming on said sheet at least one weakening line (67) adapted to form the further portion (66) which bears the undercut (70), the removable portion (15) being defined through the steps of forming the fourth sheet (64).

A 55th aspect envisages the use of a tamper-evident container (1) in accordance with any one of the aspects from the 1st to the 43rd for containing pharmaceutical and/or cosmetic and/or food products.

BRIEF DESCRIPTION OF THE DRAWINGS

Some embodiments and some aspects of the invention will be described below with reference to the attached drawings, provided solely by way of illustration and hence not by way of limitation, in which:

FIG. 2 is a schematic sectional view, taken along line II-II of the container of FIG. 1;

FIGS. 3 to 5 are schematic representations of a portion of a container;

Figure 1:
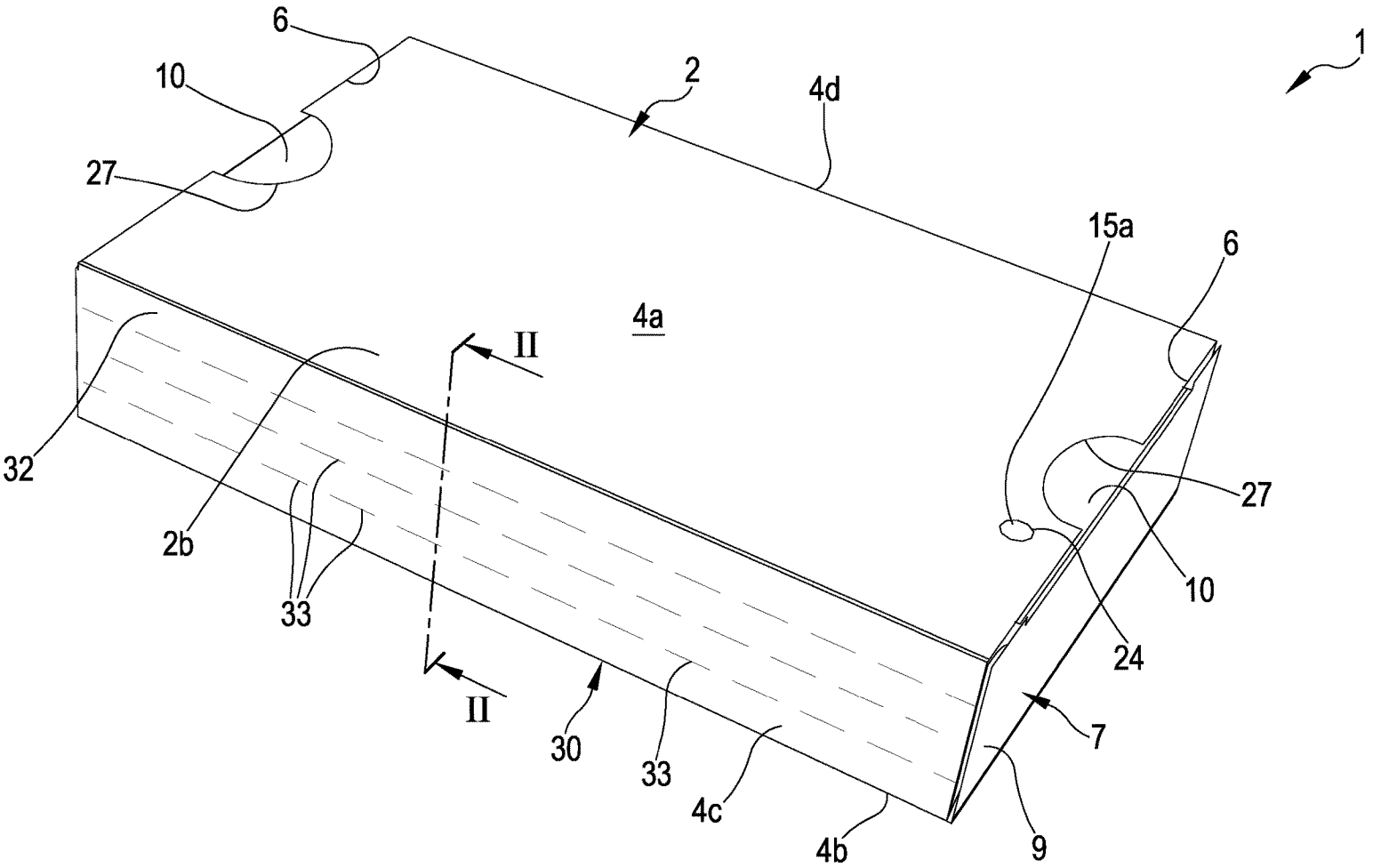
FIG. 1 is a perspective view of a container arranged in a closing condition.

It is to be noted that in the present detailed description corresponding parts illustrated in the various figures are indicated with the same numerical references. The figures may illustrate the subject of the invention through representations not in scale; therefore, parts and components illustrated in the figures relative to the subject of the invention could exclusively regard schematic representations.

The term product means an item or a set of items of any kind. For example, the product may be a drug or medicine in the solid or liquid state or in gel form, i.e. in the form of two or more of the aforementioned states of aggregation. The product can also comprise, for example: food products (e.g. sweet products), cigarettes or cigars. The term product may also mean packaging, for example blister packaging, holding a plurality of items. The term product may also mean at least one selected from the following group: one or more bottles of cosmetic items, one or more bottles of medicinal products.

The term paper material means paper or card; in particular the sheet material that can be used to make the container can have a paper basis weight comprised between 100 and 500 g/m$^2$, in particular comprised between 200 and 400 g/m$^2$. The paper material in question extends between a first and a second prevalent development surface. The sheet paper material used for making the container may, in one embodiment thereof, be covered at least on part of the first and/or second prevalent development surface with a plastic coating, e.g. a film, the aim of which is to reinforce the container. In the event that the coating is arranged so as to cover an outer surface of the container, this can also be used to define a water and/or moisture barrier useful for preventing the weakening or loss of structure of the container with the consequent deformation of the paper material constituting the latter. Advantageously but not in a limiting way, the coating may comprise a plastic film adapted to fully cover both sides (first and second prevalent development surface) of the paper material defining the container; the thickness of the coating film may have variable values between 5 and 300 μm, in particular between 10 and 200 μm, even more in particular between 10 and 100 μm. The plastic coating material may be selected for example from the following materials: LDPE, HDPE, PP, PE.

DETAILED DESCRIPTION

A. Container

1 indicates overall a tamper-evident container for containing and supporting products. The present description will not include the type of products that can be used since the container 1 may be applied, generally, in all sectors that envisage the packaging of products in order to guarantee the closure of the container itself and provide the safety that allows evidence to be highlighted of any tampering with the latter. The container 1 can be advantageously applied in the pharmaceutical and cosmetic sector, e.g. for defining dispensers adapted to house tablets or pills; in such sectors it is of interest to supply products that are intact and not altered in any way, therefore it is of interest to use containers able to provide evidence of any tampering or prior opening.

As can be seen from the attached figures, the container 1 comprises at least one storage 2, defining an internal volume 3, configured for housing products; the storage 2 essentially represents the compartment adapted to receive and support the products. The storage 2 is made of sheet material, in particular paper sheet material, wrapped at least partially on itself in order to form an overlapping zone 30; in fact, as will be described more fully below, the storage is obtained by folding at least one sheet: two portions of such sheet are overlapped to define the zone 30 (see for example FIG. 2). As can be seen more clearly from FIG. 2, the overlapping zone 30 of the storage 2 comprises at least one first constraining portion 31 and one second constraining portion 32 engaged with each other (mutually connecting portions): the first constraining portion 31 defines at least part of an internal surface of the storage 2 delimiting said internal volume 3 while the second constraining portion 32 delimits at least part of an external surface of the storage 2. In fact, the first and the second portion 31, 32 are parts of a same wrapped sheet engaged for making the storage: the stable engagement of the portions 31 and 32 allows the storage 2 to define the internal volume 3. The constraining portions 31, 32 can be engaged with each other by means of one or more glue portions, for example a cold glue. Alternatively, the first and second constraining portion 31, 32 can be stably engaged by means of one or more layers of adhesive material or similar fixing means.

Figure 6:
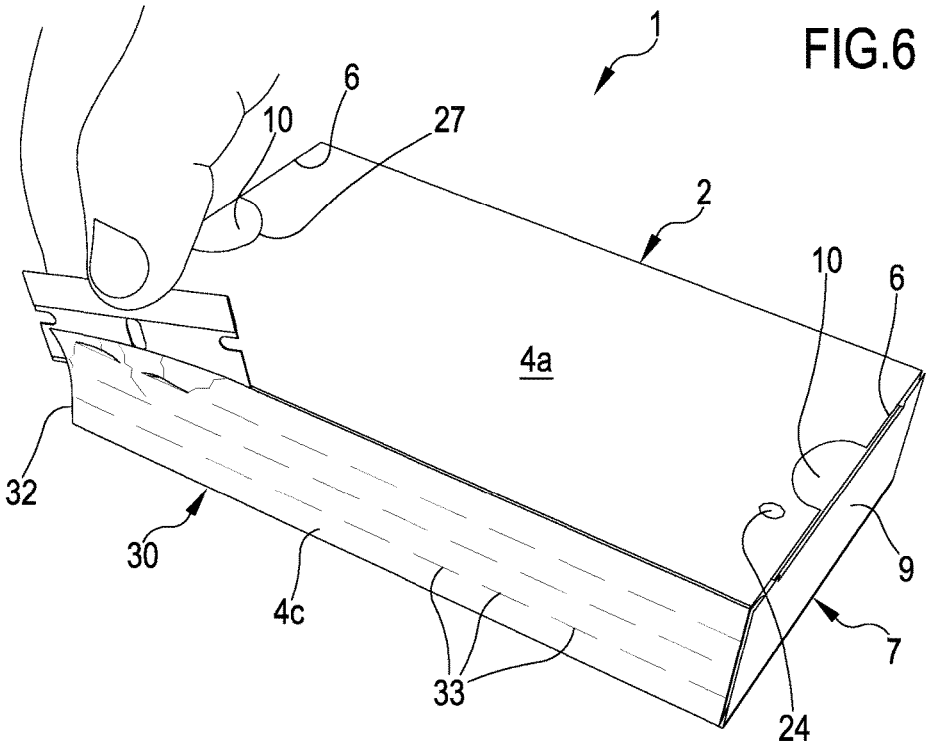
FIG. 6 schematically illustrates a tampering attempt on a container.
Figure 7:
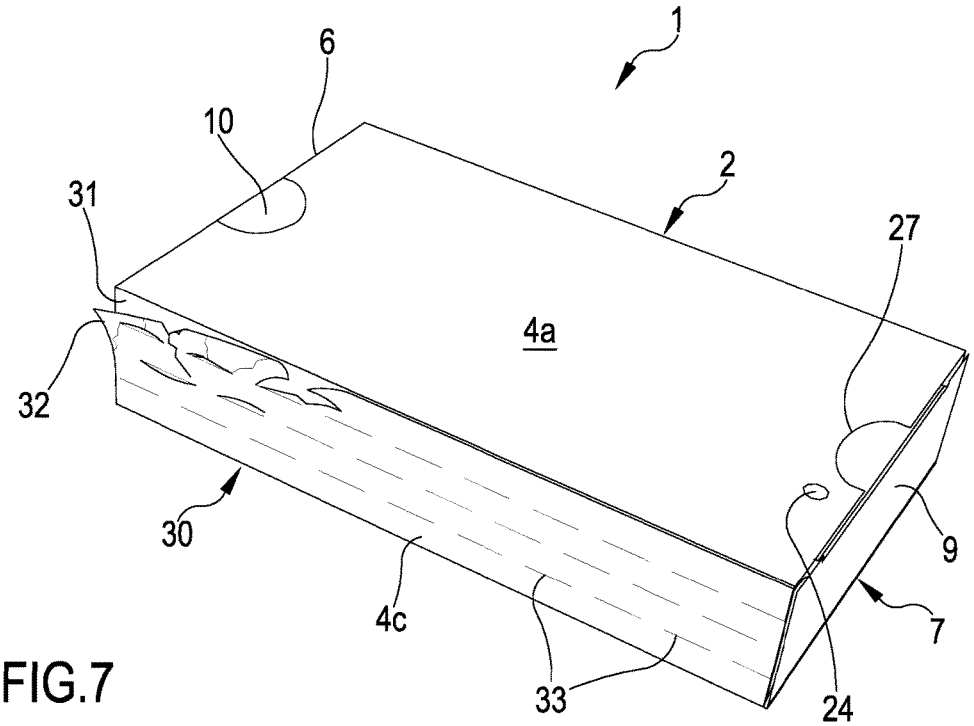
FIG. 7 schematically illustrates a condition of a container following a tampering attempt.

As can be seen, for example in FIG. 1, at least one notch 33 defining a weakening portion of the second constraining portion 32 is defined on said second constraining portion 32. In particular, the notch 33 is configured for defining a second structurally weakened constraining portion 32, unable to sustain a separation attempt of the first and second constraining portions 31, 32. In the event that any attempt were made to access the internal volume 3 (condition schematically illustrated in FIG. 6) by means of the separation of the first and second constraining portion 31, 32, thanks to the reduced structural capacity of the second portion 32 caused by the notch 33, clear damage would be caused to said second portion (visible external portion of the container as schematically illustrated in FIG. 7) which would therefore allow evidence to be provided of a tampering attempt on the container 1. FIG. 7 schematically shows the damage that could be caused to the container in the event of an attempt to access the internal volume 3 from the overlapping zone 30.

The presence of the notch 33—adapted to define the weakening portion of the storage 2—allows a tamper-proof safety system of the storage 2 to be defined that prevents the reversible opening of the latter following a first engagement between the first and the second constraining portion 31, 32.

The notch 33 passes through the second constraining portion 32. In more detail, the second constraining portion 32 of the storage 2 is made of sheet material and extends in thickness between a first and a second surface: the notch 33 extends in thickness between said first and second surface of the second constraining portion 32.

In the attached figures a preferential but not limiting embodiment of the invention has been illustrated wherein the second constraining portion 32 comprises a plurality of notches 33—advantageously passing through the portion 32—which affect a preponderant part of the second portion 32 so as to be able to define a weakening portion having a suitable extension. In particular, at least part of a notch 33 is defined on the second constraining portion 32 engaged with the first constraining portion 31: at least part of a notch is therefore defined above a glue portion interposed between the first and second constraining portion 31, 32.

FIG. 1 illustrates a non-limiting embodiment of the invention wherein the second constraining portion 32 has a weakening portion comprising a plurality of rectilinear notches 33, substantially parallel to each other and aligned along a predetermined direction. FIGS. 3 to 5 illustrate embodiments of the weakening portion comprising, for example, a plurality of notches 33 adapted to define a series of trapeziums aligned along a predetermined direction (FIG. 3), a series of rhombuses aligned along a predetermined direction (FIG. 4) or a series of lines parallel to each other (FIG. 5).

Figure 8:
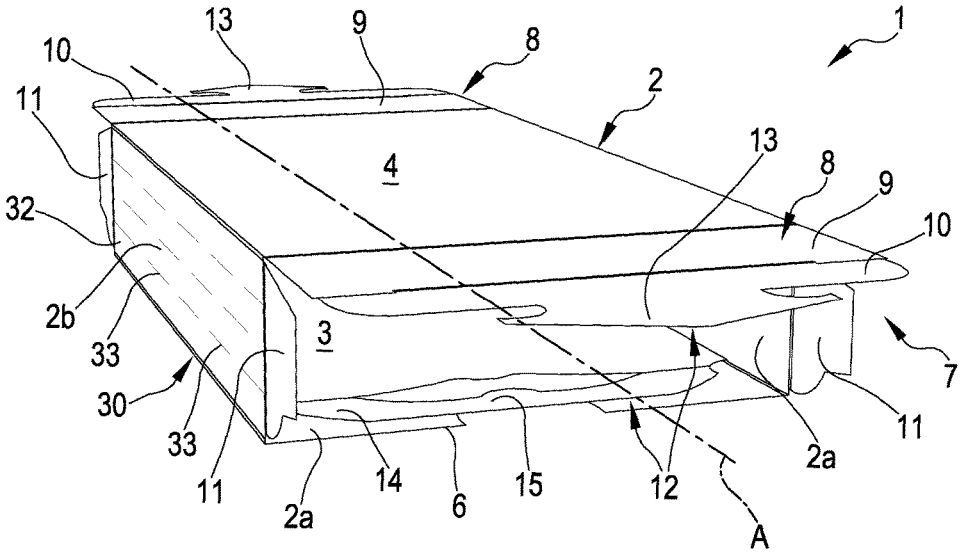
FIG. 8 is a perspective view of a container arranged in an opening condition.

The attached figures illustrate a preferential but not limiting embodiment of the container 1 in which the storage 2 comprises at least one lateral wall 4 defining at least one passage opening 5 delimited by a free edge 6; the passage opening 5 is configured for establishing a communication between the internal volume 3 and the external environment. The lateral wall 4 is wrapped at least partially on itself along a longitudinal axis A and defines a tubular shape (see for example FIG. 8); the lateral wall 4—wrapped at least partially on itself—forms the overlapping zone 30 which extends longitudinally along said axis A. In such configuration, the weakening portion of the second constraining portion 32 of the overlapping zone 30 extends parallel to axis A and in particular has a predetermined longitudinal extension measured along said axis A of the lateral wall 4. Preferably, although not by way of limitation, the ratio of the longitudinal extension of the weakening portion to the longitudinal extension of the lateral wall 4—both measured along the longitudinal axis A—is greater than 0.3, particularly greater than 0.5, still more particularly is comprised between 0.5 and 1. The attached figures illustrate a preferential but not limiting embodiment of the invention wherein the overlapping zone 30 substantially extends along all the longitudinal development of the lateral wall 4; the notches 33 affect all the longitudinal development of the wall 4 and in particular all the development of the second constraining portion 32 measured along the axis A.

As can be seen from the attached figures, the lateral wall 4 has, along a cross-section normal to said longitudinal axis A, a closed outline tubular shape: the lateral wall 4 defines—at opposite longitudinal end edges—respective free edges 6 each of which delimits a passage opening 5 configured for establishing a communication between the internal volume 3 of the storage 2 and the external environment; in such configuration, the weakening portion of the second constraining portion 32 is defined between said longitudinal edges of the lateral wall 4 and in particular extends between opposite free edges 6 (between the two respective passage openings 5 defined by said edges 6) of the lateral wall 4. The attached figures illustrate an embodiment of the weakening portion extending between said opposite edges 6: the notch 33 or plurality of notches affect all the longitudinal development of the lateral wall 4 starting from one free edge 6 until the opposite free edge 6 (see for example FIG. 1).

The attached figures illustrate, in a non-limiting way, a configuration of the storage 2 having two passage openings 5 opposite each other with respect to the storage 2 itself so that the latter can substantially define a conduit or tube delimited laterally by said wall 4 and open at longitudinal ends. However, the possibility is not excluded of making, for example, a storage 2 having a single passage opening 5 or even a greater number of openings 5 than two (conditions not illustrated in the attached figures).

The attached figures illustrate a preferential but not limiting configuration of the storage 2 having a rectangular prismatic shape (four flat lateral walls 4 having a rectangular shape); in fact, the storage has a front wall 4*a* and a rear wall 4*b* facing and parallel to each other: the front wall 4*a* and the rear wall 4*b* are connected to each other by means of a first and a second lateral wall 4*c*, 4*d* also facing and parallel to each other. The front wall 4*a* is distanced from the rear wall 4*b*; the first and the second lateral wall 4*c*, 4*d* of the storage 2 are also distanced from each other. The front and rear wall 4*a*, 4*b* have an identical rectangular shape (identical walls in shape and size); the lateral walls 4*c*, 4*d* have an identical rectangular shape (identical walls in shape and size). However, the possibility is not excluded of making a storage 2 having a different shape, for example square, trapezoidal or cylindrical.

In the configuration illustrated, the overlapping zone 30 is defined at least in part on said first connecting wall 4*c*. In such configuration, the first connecting wall 4*c* is entirely defined (in particular exclusively) by the second constraining portion 32 overlapping and engaged with the first constraining portion 31. The first constraining portion 31 represents the part of the wall 4*c* that is not visible and positioned inside the volume 3; the first constraining portion 31 defines at least part of the internal surface of the storage 2 while the second constraining portion represents the external part (external surface) of the storage 2.

FIG. 2 illustrates an embodiment of the invention in which only one part (width) of the lateral connecting wall 4*c* defines the overlapping zone 30. However, the possibility is not excluded of making a lateral connecting wall 4*c* fully defining the overlapping zone 30, i.e. having a first and second constraining portion 32 having the same size as said wall 4*c*.

Figure 9:
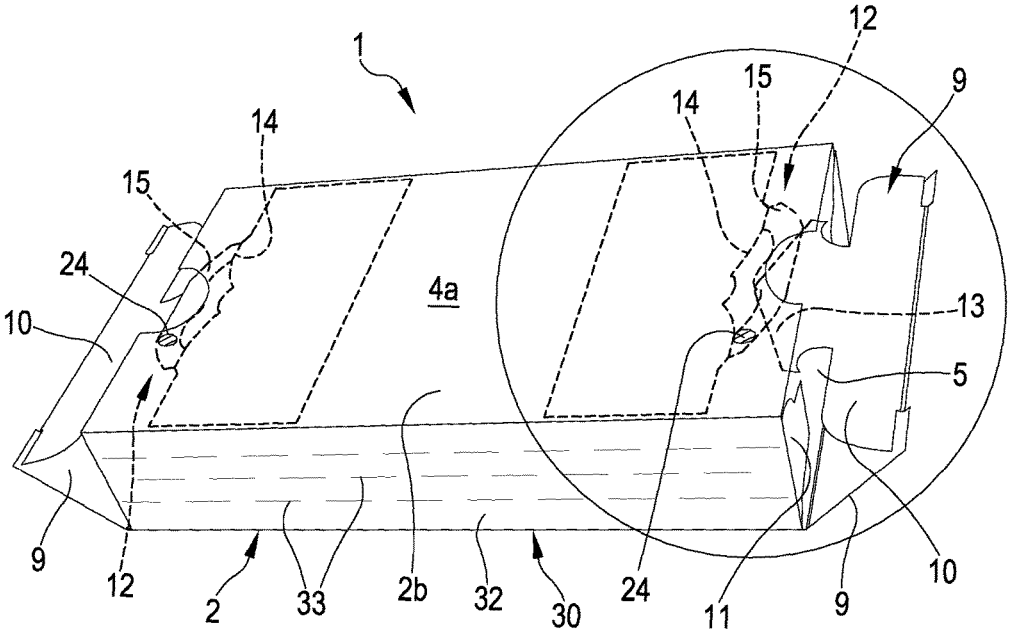
FIG. 9 is a perspective view of a container during a first closing condition.

In a non-limiting embodiment of the invention, the storage 2 can for example comprise at least one through control opening 24 (see, for example, FIGS. 1, 9 and 10) arranged substantially at the free edge 6 of the passage opening 5. The attached figures illustrate a configuration of the opening 24 which defines a closed perimeter edge distanced from the free edge 6 of the storage; the opening 24 may have, in a non-limiting way, a cylindrical, rectangular, elliptical or square shape. Alternatively, the opening 24 may have an open perimeter edge adapted to define at least part of the free edge 6; in such configuration, the opening 24 substantially comprises a through break defined on the lateral wall 4 of the storage in continuity with the free edge 6: the break (opening 24) essentially defines a drop of the free edge 6.

In the event in which the control opening 24 is distinct and distanced from the free edge 6, i.e. is defined by a closed outline opening, the storage 2 may also comprise—still in a non-limiting way and in addition to the control opening 24—a break 27 defined at the free edge 6; as can be seen from the attached figures, the break 27 is in contact with the free edge 6 for defining on the latter a sort of drop: the break 27 essentially represents a lowered and continued portion of the free edge 6. In more detail, the break 27 is defined on the lateral wall 4 of the storage 2 in particular on the same lateral wall on which the control opening 24 is defined. The break 27 has an open perimeter outline having a substantial "C", "V" or "U" shape, whose concavity faces the opposite side to the internal volume 3 of the storage 2. The drop (break 27) only extends for a small part on the lateral wall on which, in particular, the maximum depth of the break 27 is greater than or equal to 1 mm, in particular comprised between 1 and 10 mm; the maximum depth is represented by the maximum distance between the free edge 6 and a bottom edge of the break 27.

In a preferential but non-limiting embodiment of the invention, the storage 2 is made of sheet material, in particular paper sheet material (fully made of paper material), and obtained for example by folding. In more detail, the sheet of the storage 2 is defined in thickness between an internal surface 2*a* delimiting the internal volume 3 and an external surface 2*b*—opposite the internal surface 2*a*—that delimits the outside of the storage 2.

As can be seen from the attached figures, the container 1 further comprises a closure system 7 also made of sheet material, in particular paper sheet material, engaged at the free edge 6 and movable, particularly by rotation, with respect to the storage 2. In particular, the closure system 7 is configured for defining a closing condition (see for example FIG. 1) in which the system 7 itself prevents communication between the internal volume 3 of the storage 2 and the external environment; the closure system 7 is further configured to define at least one opening condition (see for example FIG. 8) in which the system 7 itself allows communication between the internal volume 3 and the external environment. In fact, the system 7 substantially represents a lid adapted to cooperate with the storage 2 in order to manage the access to the internal volume 3. Advantageously, the container 1 comprises a closure system 7 for each passage opening 5 of the storage 2. The attached figures illustrate, by way of non-limiting example, a configuration of the container 1 having two passage openings 5; in such condition, the container 1 has two closure systems 7 engaged with respective free edges 6 of the storage 2: the systems 7 are arranged opposite each other with respect to the storage 2 itself. The closure system 7 is advantageously although without limitation joined in one piece to the storage 2, in particular to the free edge 6, and is movable by rotation about the latter between at least the closing and opening conditions.

In more detail, the closure system 7 comprises at least one tab 8 which has a closure portion 9 directly engaged and joined in one piece to the free edge 6 of the storage 2: the closure portion 9 represents the component of the tab 8 configured to prevent the passage through the opening 5 in the closing condition of the system 7 itself. As can be seen from the attached figures, the closure portion 9 substantially comprises a flat body made of sheet material (e.g. paper sheet material) counter-shaped to the free edge 6 of the opening 5. In the attached figures, a preferential configuration of the closure portion 9 is depicted, having a rectangular shape fully counter-shaped to the free edge 6: in the closing condition of the system 7, the closure portion 9 is arranged at the free edge 6 for internally occluding the passage opening defined by said edge 6.

Figure 13:
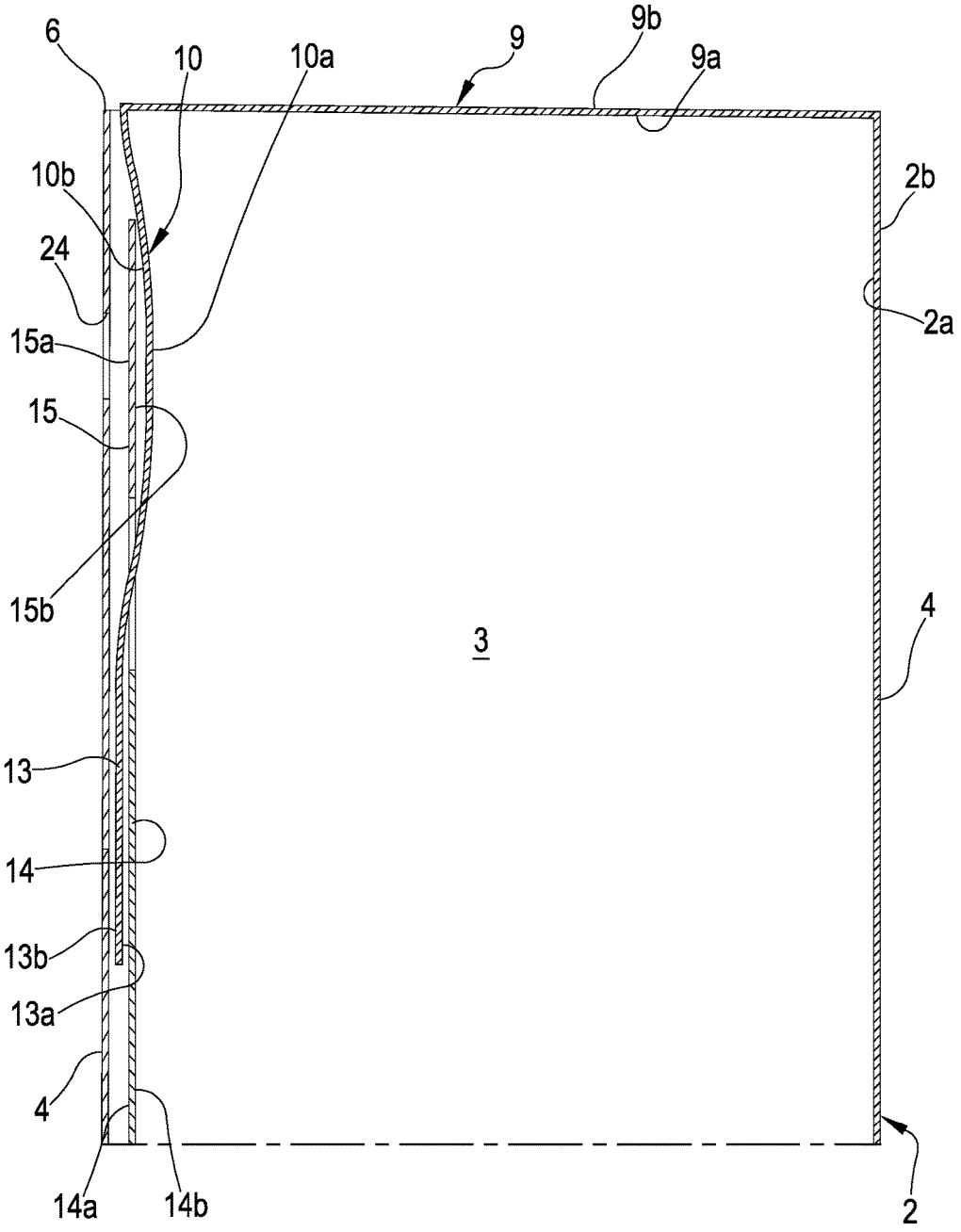
FIG. 13 is a sectional view, taken along line XIII-XIII, of the container of FIG. 12.
Figure 14:
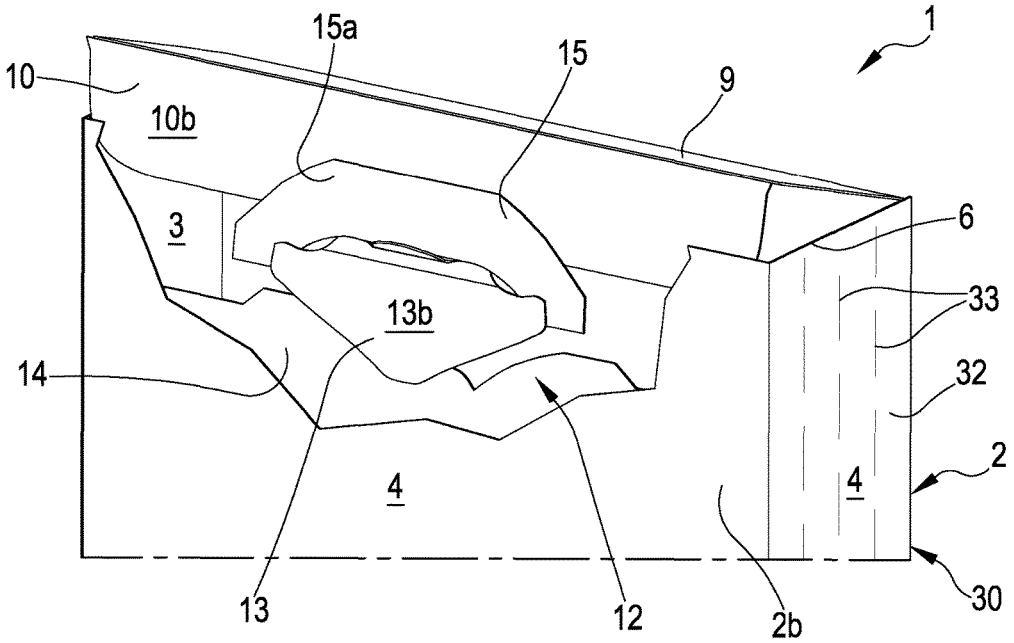
FIG. 14 is a schematic view of a container during a first opening condition of the container itself.

The closure portion 9, made of sheet material, is defined in thickness between a first and a second surface 9*a*, 9*b* (see for example FIG. 13). The closure portion 9 is joined in one piece to the storage 2: the closure portion 9 is the same piece as the storage. The first extension surface 9*a* of the portion 9 is positioned in continuity with the internal surface 2*a* of the storage 2 so that the internal surface 2*a* and the first surface 9*a* essentially define a single extension surface. The second extension surface 9*b* of the portion 9 is positioned in continuity with the external surface 2*b* of the storage 2 so that the internal surface 2*b* and the second surface 9*b* essentially define a single extension surface.

The tab 8 further comprises at least one engagement portion 10 configured for inserting, in the closing condition of the closure system 7, into the volume 3 of the storage 2. The engagement portion 10 is joined in one piece to the closure portion 9 and emerges from a perimeter edge of the latter opposite the free edge 6 of the storage 2: the engagement portion 10 substantially represents an extension of the closure portion 9 adapted to be inserted, in the closing condition of the closure system 7, inside the storage 2.

As can be seen from the attached figures, the engagement portion 10 substantially comprises a flat body made of sheet material having, in a non-limiting way, a substantially rectangular shape; the possibility is obviously not excluded of making an engagement portion having a different shape.

Also the engagement portion 10 is defined in thickness between a first and a second surface 10*a*, 10*b* (see for example FIG. 13). The engagement portion 10 is joined in one piece to the closure portion 9 and in particular to the storage 2: the engagement portion 10 is the same piece as the closure portion 9 and in particular as the storage. The first extension surface 10*a* of the portion 10 is positioned in continuity with the first surface 9*a* so that the latter and the first surface 10*a* essentially define a single extension surface. The second extension surface 10*b* of the engagement portion 10 is instead positioned in continuity with the second external surface 9*b* so that the latter and the second surface 10*b* essentially define a single extension surface.

In fact, the first surface 10*a* of the engagement portion 10 is positioned in continuity with the internal surface 2*a* of the storage 2 by means of the first surface 9*a* of the closure portion 9; the second surface 10*b* of the engagement portion 10 is instead positioned in continuity with the external surface 2*b* of the storage 2 by means of the second surface 9*b* of the closure portion 9.

As described above, the engagement portion 10—in the closing condition of the closure system 7—is configured to be inserted at least partially into the internal volume 3 of the storage 2 (see for example FIGS. 9 to 13); in the closing condition of the system 7, the second surface 10*b* of the engagement portion 10 is facing (turned) towards and abutting (at least partially) on the internal surface 2*a* of the storage 2. In particular, the second surface 10*b*—in the closing condition of the system 7—is facing, in particular is in direct contact with, the lateral wall 4 of the storage 2 and in particular the front lateral wall 4*a* of the storage 2 opposite the rear lateral wall 4*b* directly connected to the closing system 7 (see for example FIG. 13).

As can be seen for example from FIG. 13, the second surface 10*b* of the engagement portion 10—in the closing condition of the system 7—faces directly and extends substantially parallel to the lateral wall (e.g. the front lateral wall) of the storage 2 on which the control opening 24 and/or the break 27 are defined.

The first surface 10*a* of the engagement portion 10—in the closing condition of the system 7—is also facing towards the internal surface 2*a* of the storage: in particular, the surface 10*a* is facing towards the internal surface 2*a* of the storage 3 defining the rear lateral wall 4*b*, i.e. the lateral wall 4 directly connected to the closing system 7 (FIG. 6A).

The closing portion 9 and the engagement portion 10 have a mutual connecting edge opposite the free edge 6 of the storage 2 with respect to the closing portion 9 itself: the engagement portion 10 is movable by rotation with respect to the closing portion 9 about said mutually connecting edge. As can be seen for example from FIG. 8, the engagement portion 10, in the closing condition of the system 7, is configured for defining, according to a cross section and in cooperation with the closing portion 9, a substantially L-shaped outline: in this condition the engagement portion 10 extends substantially parallel to a lateral wall 4 of the storage 2, in particular substantially parallel to the front 4*a* and rear 4*b* lateral walls of the storage. As can be seen for example from the attached figures, the closing system 7 may also comprise—in a non-limiting way—at least one abutment portion 11 engaged with the free edge 6 of the storage 2 adjacent to the tab 8: the abutment portion 11, in the closing condition, is configured to be interposed between the internal volume 3 and the tab 8 so as to cooperate with the latter to keep it stably in said closing condition. The abutment portion 11 essentially comprises a flat tab made of sheet material joined in one piece to the free edge 6 of the storage 2 adjacent to the closing portion 9. The abutment portion 11 has, in a non-limiting way, a rectangular or trapezoidal shape. The abutment portion 11 is also configured to rotate about the free edge 6 to face, at least in the closing condition of the container 1, towards the inside of the storage 2. In more detail, the abutment portion 11 is constrained to the free edge 6 so as to be able to engage, in the closing condition of the container 1, at least part of the engagement portion 10 and/or of the closing portion 9 to keep the tab 8 stably in said condition.

Advantageously, the container 1 comprises two abutment portions 11 opposite each other with respect to the tab 8: the latter is interposed between the two abutment portions 11. In such configuration, the two portions 11 work symmetrically on the tab 8 to keep it stably in the closing condition.

As described above, the storage 2 may for example comprise a through control opening 24; as can be seen from the attached figures, the control opening 24 is arranged on the lateral wall 4 (front lateral wall 4*a*) configured to directly face—in the closing condition of the system 7—the engagement portion 10, in particular the second surface 10*b* of said portion 10. The control opening 24 is therefore arranged in proximity to the second surface 10*b* and is configured for allowing the latter to be viewed in determined operating conditions of the container 1 which will be described more clearly below. The opening 24 may—additionally or alternatively—be configured to allow the engagement portion 10 to be viewed and the correct insertion thereof into the storage 2 as will be described more clearly below.

Furthermore, as described above, the storage 2 may for example comprise a break 27; as can be seen for example from FIG. 1, the break 27 is arranged on the lateral wall 4 (front lateral wall 4*a*) configured to directly face the engagement portion 10, in particular the second surface 10*b* of said portion 10. The break 27 is therefore arranged in proximity to the second surface 10*b* and is configured for allowing the latter to be viewed in determined operating conditions of the container 1 which will be described more clearly below.

As specified above, the entire closing system 7, defined by the tab (portions 9 and 10) and optionally by the abutment portions 11, is made of sheet material; preferably, the system 7 is made entirely of paper (paper or card) sheet material. In particular, the closing system 7 and the storage 2 are made in a single piece through the same paper sheet.

In a preferential but non-limiting embodiment of the invention, the container 1 may for example comprise (in its first embodiment) a safety device 12, made of sheet material, engaged at least partially with the storage 2 and at least partially with the closure system 7; the safety device 12 comprises at least one removable portion 15 configured for separating from at least one between said closure system 7 and storage 2 following a first opening of the closure system 7. The term first opening of the system 7 means a first opening condition that takes place following a first closure (also known as reinforcement) of the same closure system 7; in fact, the system 7 when closed for the first time is arranged in a first closing condition: the first time passing from the first closing condition to an opening condition of the system 7 is defined as first opening. In other words, the first opening is the first opening of the container 1 after it has been closed for the first time. Thanks to the separation of the removable portion 15 from at least one from among the storage 2 and the closing system 7, the container 1 is able to highlight a first opening of the latter and therefore any tampering with the products contained therein.

The attached figures illustrate a preferential but non-limiting embodiment of the invention wherein the safety device 12 comprises at least one first hooking portion 13, borne by the tab 8 and at least one second hooking portion 14 engaged to the storage 2. The first and the second hooking portion 13, 14 are configured to be stably engaged with each other during a first closure of the closing system 7 or during a first absolute closure of the system 7 wherein the engagement portion 10 is first inserted into the storage 2. Advantageously, the second hooking portion 14 is defined in the storage 2, in particular in the internal volume 3: the engagement between the first and second hooking portion 13, 14 is therefore also defined inside the storage 2.

In detail and as can be seen from the attached figures, the first hooking portion 13 is engaged, in particular directly borne, by the tab 8 of the closure system 7 (alternatively it could further be borne by at least one abutment portion 11). In more detail, the first hooking portion 13 is borne exclusively, but in a non-limiting way, by the engagement portion 10: the two portions 10 and 13 are advantageously joined in one piece to form a single body. The first hooking portion 13 comprises an emerging flat sheet body, in particular without any break in continuity, by the engagement portion 10 opposite the closing portion 9: the engagement portion 10 is therefore interposed between the closure portion 9 and the first hooking portion 13. The first hooking portion 13, in the closing condition of the system 7 and therefore during the insertion of the engagement portion 10 in the storage 2, is also configured to be inserted in the internal volume 3.

The first hooking portion 13 is defined in thickness between a first and a second surface 13*a*, 13*b* (see for example FIG. 13). The first hooking portion 13 is joined in one piece to the engagement portion 10: the first hooking portion 13 is the same piece as the engagement portion and therefore as the tab 8. The first extension surface 13*a* of the hooking portion 13 is positioned in continuity with the first surface 10*a* so that the latter and the first surface 13*a* essentially define a single extension surface. The second extension surface 13*b* of the first hooking portion 13 is instead positioned in continuity with the second surface 10*b* so that the latter and the second surface 13*b* essentially define a single extension surface.

In fact, the first surface 13*a* of the first hooking portion 13 is positioned in continuity with the internal surface 2*a* of the storage 2 by means of the surfaces 10*a* and 9*a*; the second surface 13*b* is instead positioned in continuity with the external surface 2*b* of the storage 2 by means of the surfaces 10*b* and 9*b*.

As described above, the first hooking portion 13—in the closing condition of the closure system 7—is inserted at least partially into the internal volume 3 of the storage 2 (see for example FIG. 12); in the closing condition of the system 7, the second surface 13*b* is facing (turned) towards the internal surface 2*a* of the storage 2. In particular, the second surface 13*b*—in the closing condition of the system 7—is facing the front lateral wall of the storage 2 opposite the rear lateral wall directly connected to the closing system 7.

As can be seen for example from FIG. 13, the second surface 13*b* of the first hooking portion 13—in the closing condition of the system 7—faces and extends substantially parallel to the lateral wall (e.g. the front lateral wall) of the storage 2 on which the control opening 24 and/or the break 27 are defined. The first surface 13*a* of the portion 13—in the closing condition of the system 7—is also facing towards the internal surface 2*a* of the storage: in particular, the surface 13*a* is facing towards the internal surface 2*a* of the storage 3 defining the rear lateral wall 4*b*, i.e. the lateral wall 4 directly connected to the closing system 7.

In fact, the surfaces 13*a* and 13*b* of the first hooking portion 13 are respectively turned in the same direction as the first and second surface 10*a*, 10*b* of the engagement portion 10: the second surfaces 10*b*, 13*b* are without any break in continuity with each other and directly face the same lateral wall 4 (front lateral wall) of the storage 2 opposite the lateral wall 4 connected directly to the system 7. In other words, the second surfaces 10*b*, 13*b*—in the closing condition of the system 7—are turned towards the outside of the container i.e. in a direction coming out from the internal volume 3. The second surfaces 10*a*, 13*a* are also without any break in continuity with each other and turned towards the internal volume 3 of the storage 2.

In more detail, the first hooking portion 13 comprises at least one undercut portion 20 delimited by a gripping edge 21: the undercut portion 20, in the first closing condition of the container 1, is configured to be engaged with the second hooking portion 14 arranged inside the storage 2. As can be seen for example from FIG. 10, the undercut 20 comprises at least one hook 22 defining a seat 23 whose concavity is turned, at least during the first closing condition of the closure system 7, towards at least one of the lateral walls 4 of the storage 2, in particular it is turned towards an abutment portion 11 of the system 7. The seat 23 of the undercut portion 20 defines a substantially C-shaped outline: the gripping edge 21 delimits a portion of said seat 23.

The attached figures show a preferential but non-limiting configuration of the first hooking portion 13 which substantially comprises two hooks 22 opposite each other. In this condition, the first portion 13 therefore comprises two respective undercut portions 20 which, at least in the first closing condition of the container 1, are both configured to be engaged with the second hooking portion 14. The two undercut portions 20 comprise respective seats 23 whose concavity is turned in the opposite direction with respect to each other: the concavity of the seats 23 is turned towards respective abutment portions 11 of the storage 2. The presence of two undercuts 20 substantially defines a double symmetrical grip on the second hooking portion 14 which makes the hooking between said first and second hooking portion 13, 14 more effective and stable.

As previously described, the second hooking portion 14 of the device 12 is engaged inside the storage 2. The position inside the storage 2 of the second hooking portion 14 ensures that the engagement between the latter and the first hooking portion 13 is defined in the closure condition of the system 7 i.e. in the condition in which the first hooking portion 13 is inserted at least partially in the internal volume 3.

The attached figures illustrate a configuration of the second hooking portion 14—made of sheet material—extending along a plane substantially parallel to the lateral wall 4 of the storage 2 with which it is associated. In this configuration, the second hooking portion 14 is engaged—for example directly—with the front lateral wall 4*a* (flat wall) of the storage 2: the second hooking portion 14 is substantially parallel to said front lateral wall of the storage or at the most has a slight inclination with respect to the latter less than 20°, in particular less than 10°.

The second hooking portion 14 is joined in one piece to the storage 2, in particular it is joined in one piece to the front lateral wall 4*a* of the storage 2. As for the first hooking portion 13 the second portion 14 also comprises a body made of sheet material delimited in thickness between a first and a second surface 14*a*, 14*b*. The first surface 14*a* of the portion 14, in the closing condition of the system 7, is parallel and facing the internal surface 2*a* of the storage 2.

The first and/or the second hooking portion 13, 14 may comprise said removable portion 15 of the safety device 12. In the preferential but non-limiting configuration illustrated in the attached figures, the second hooking portion 14 comprises the removable portion 15; such removable portion 15 is made of sheet material and extends between a first and a second surface 15*a*, 15*b* (see for example FIG. 13) which substantially represent extensions of the surfaces 14*a*, 14*b* of the second hooking portion 14. In fact, the first surface 15*a* of the removable portion 15, in the closing condition of the system 7, is substantially parallel to and directly facing the internal surface 2*a* of the storage 2 and in particular facing the front lateral wall of said storage 2; the second surface 15*b* is instead substantially parallel to and directly facing the second surface 10*b* of the engagement portion 10.

In fact, as depicted in the sectional view of FIG. 13, the removable portion 15—in the first closing condition of the system 7—is interposed between the engagement portion 10 and the lateral wall 4 (in particular the front lateral wall) of the storage 2. The removable portion 15 comprises at least one undercut portion 16 which is configured for engaging, in the first closing condition of the system 7, with the respective undercut portion 20 of the first hooking portion 13. The undercut portion 16 of the removable portion 15 is delimited by a gripping edge 17 which, in the first closing condition of the container 1 itself, is distinct and distanced from the free edge 6 of the storage 2: the undercut portion 16 is inside the storage 2 (totally inside the storage) and distanced from the passage opening 5 (distanced from the free edge 6) so that the removable portion 15 can be engaged, in the first closing condition, with the respective undercut 20 of the first hooking portion 13.

Figure 10:
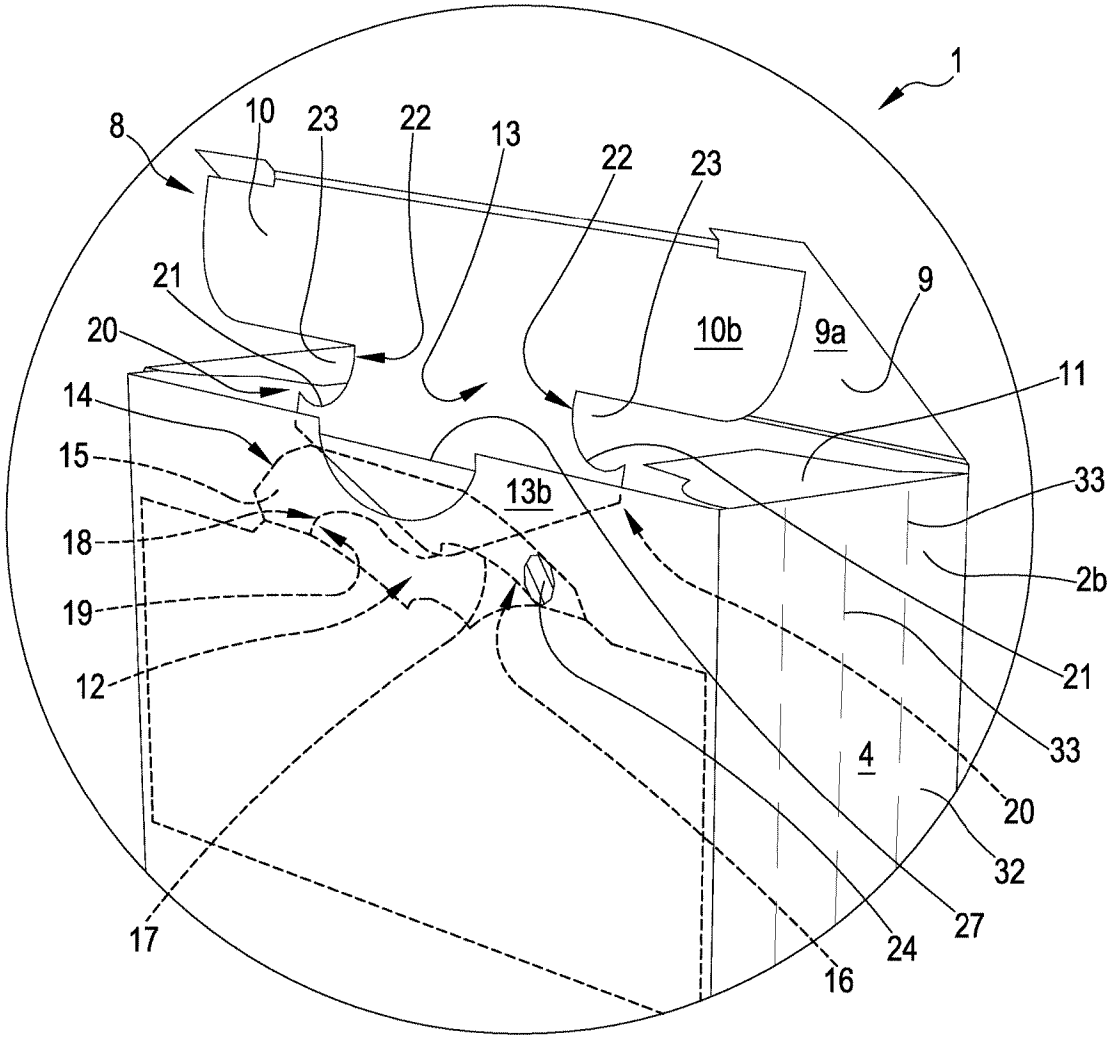
FIG. 10 is a detailed view of the container of FIG. 9.
Figure 11:
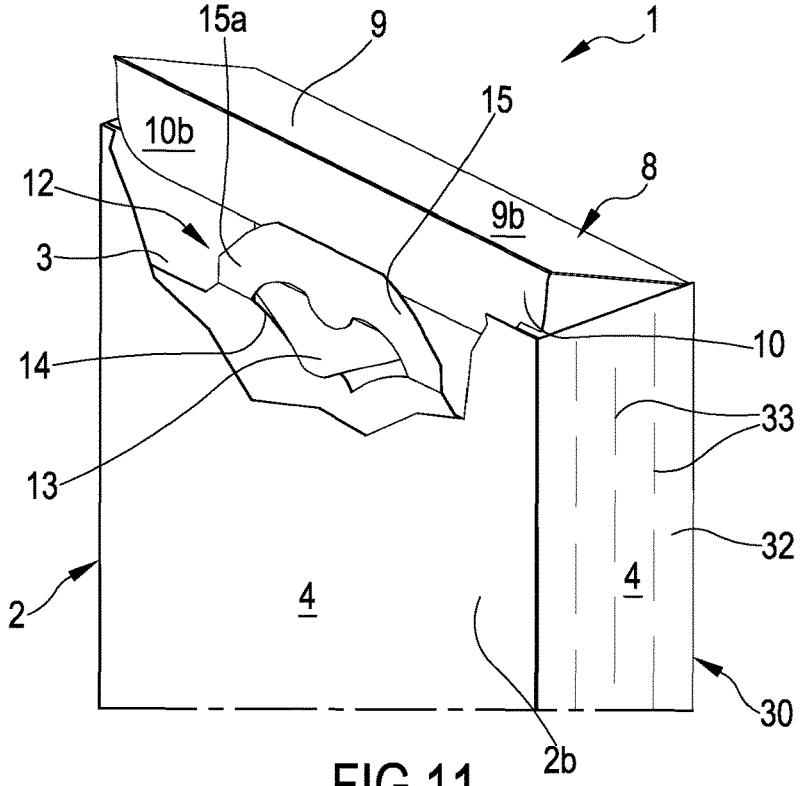
FIGS. 11 and 12 are schematic representations of a during the first closure steps of the container itself.

As can be seen for example from FIG. 10, the undercut portion 16 of the removable portion 15 comprises at least one hook 18 defining a seat 19 whose concavity is facing towards at least one of the lateral walls 4 of the storage 2. In particular, the seat 19 has a substantially C-shaped outline: the gripping edge 17 delimits the portion of the seat 19 facing the free edge 6 of the storage 2. In more detail, it is possible to observe that the gripping edge 17 of the removable portion 15, in the first closing condition of the container 1 itself, is interposed between the free edge 6 of the storage 2 and the respective gripping edge 21 of the first hooking portion 13.

The attached figures show, in a non-limiting way, a configuration of the removable portion 15 which has two undercuts 16 arranged opposite each other with respect to the removable portion 15 itself: the concavities of the respective seats 19 are opposite each other and turned towards respective abutment portions 11 of the storage 2. In relation to the first hooking portion 13, it is instead possible to observe that the concavity of the seat 19 of the removable portion 15, in the first closing condition of the container 1, is facing the concavity of the seat 23 of the respective undercut portion 20 of the first portion 13.

As described above, the first and second hooking portion 13, 14 of the safety device 12 are configured for defining a first closing condition substantially defined by the first engagement/hooking of said portions. Prior to the first closing condition, the first hooking portion 13 is arranged outside the internal volume 3 while the second hooking portion 14 lies inside the storage 2 (condition illustrated in FIGS. 2 and 10). Subsequently, the closure system 7 is guided for the first time into the storage 2 as illustrated, for example, in FIGS. 3-5: during this step the system 7 is configured for defining the closing condition of the container 1 and at the same time the first engagement takes place between the first and second hooking portion 13, 14 of the safety device 12. In fact, during the first closing condition of the container 1, the hook 18 of the removable portion 15 engages the hook 22 of the first portion 13. In even more detail, during the first closing condition the body made of sheet material of the first hooking portion 13 is configured to slide, initially behind the removable portion (the removable portion 15 is interposed between the first hooking portion 13 and a lateral wall 4 of the storage 2) to then cross the seat 19 and be interposed between the lateral wall 4 of the storage 2 and the second hooking portion 14. Alternatively, the hooking portion can initially slide in front of the removable portion 15 to then cross the seat 19: in this condition it is the second portion 14 that is interposed between the lateral wall 4 of the storage 2 and the first hooking portion 13.

Figure 12:
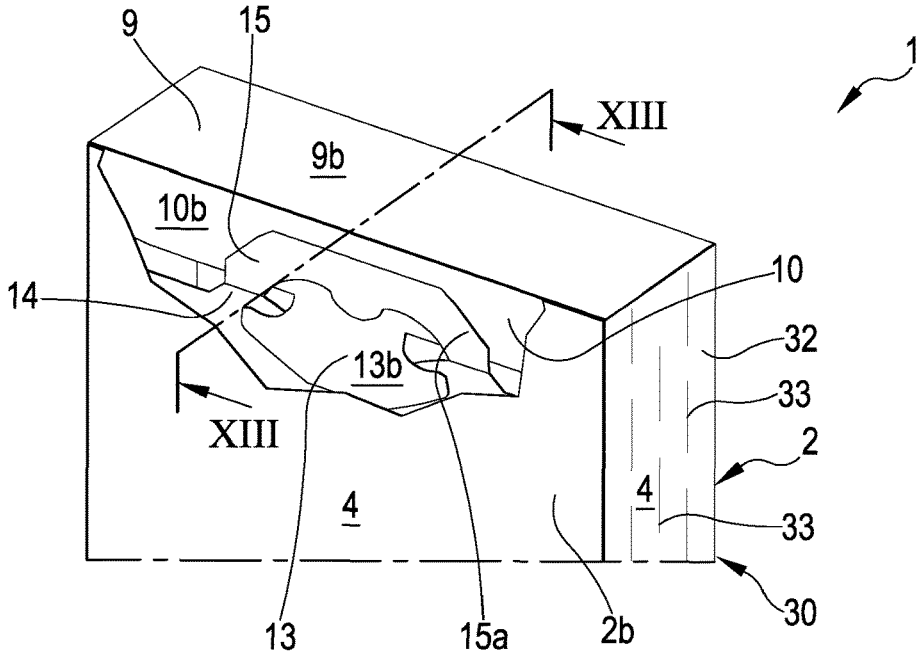

The first closing position of the container 1 is schematically illustrated in FIGS. 12 and 13. In this condition, the hook 18 of the removable portion 15 is abutted and stably engaged with the hook 22 of the first portion 13: in this condition, the first portion 13 is entirely inserted inside the seat 17 of the removable portion 15 and the respective undercuts 16 and 20 define a stable engagement condition between the portions 13 and 14.

As specified above, the storage 2 may comprise the control opening 24; if present, such opening is borne by the lateral wall 4 (front lateral wall **4*a*) parallel to and in direct contact with the second hooking portion 14 of the safety device 12; the control opening 24 is advantageously arranged at the removable portion 15 of the safety device 12 and at the engagement portion 10 of the tab 8**.

The control opening 24 is configured to allow the removable portion 15 to be viewed, in particular the first surface **15*a*, prior to the first opening condition of the container 1 (during the first closing condition of the container 1); the control opening 24 is further configured to allow the engagement portion 10 to be viewed, in particular the second surface 10*b*, following the first opening of the closure system 7 (of the container 1) to provide visual evidence of any tampering with the container 1. In a preferential but non-limiting embodiment of the invention, the control opening 24 is configured for allowing the removable portion 15 to be viewed from the outside and/or for allowing the correct engagement (reinforcement) of the safety device 12 to be viewed and in particular the correct insertion/engagement of the first portion 13 in the second portion 14 and therefore the correct reinforcement of the device 12**.

It is also highlighted that the constraint of the removable portion 15 to the first hooking portion 13 defines a stable engagement between the storage 2 and the closure system 7 which opposes the opening of the container 1—at the first opening the user notices a substantial resistance to the opening of the container—providing evidence that the latter has not yet been opened. During the first opening condition, the safety device 12 is configured to allow the detachment of the removable portion 15 from the second hooking portion 14. The first opening condition is for example illustrated in FIG. 6: during the first opening of the system 7, the first hooking portion 13 grips on the removable portion 15 (grip between hooks 18 and 22) and tears it from the second portion 14.

Figure 15:
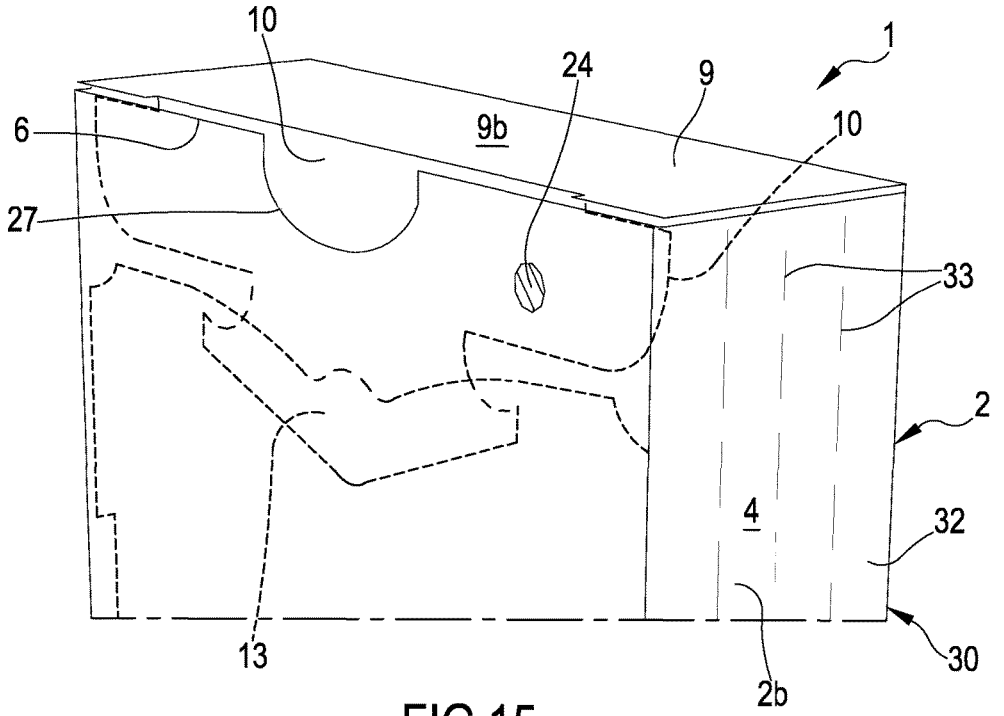
FIG. 15 is a schematic view of a container arranged in a closing condition following a first opening condition of the container itself.

Following the first opening condition, the device 12 is able to provide evidence of tampering since the opening of the system 7 is easier: during opening the user does not perceive a resistance on the engagement portion 10 (see FIG. 15 in which the absence of the removable portion is clear). Furthermore, following the first opening condition, the control opening 24 allows the engagement portion 10 to be viewed in the place of the removable portion 15 (alternatively it allows the internal volume of the storage 2 to be viewed): in this condition, the user can easily realise that the container 1 has been tampered with without continuing to open it. Advantageously, it is possible to differentiate between surfaces **15*a* and 10*b* respectively of the removable portion 15 and of the engagement portion 10 so as to promote the recognition of said surfaces and thus accentuate the evidence of tampering. For example, it is possible to provide two different colours of the surfaces 15*a* and 10*b*: in this way the user can only realise the container 1 has been tampered with through the recognition of the colour of the engagement portion 10 rather than on the removable portion 15**.

In a preferential but non-limiting embodiment of the invention, the device 12 (portions 13, 14 and 15) is entirely made of paper (paper or card) sheet material; in particular the paper sheet material used for making the device 12 is the same as the sheet material used for making the storage 2 and the closure system 7.

It is useful to specify how the solution described above represents a preferential but still non-limiting configuration of the container 1. In fact, the removable portion 15 could indistinctly constitute at least part of the first and/or second hooking portion 13, 14. For example, the removable portion 15 could define the respective undercut 20 and therefore the hook 22 of the first hooking portion 13: in that case, during the first opening of the container, the removable portion 15 would be configured to be separated from the first portion 13. As described above, the possibility is not excluded of defining at least one removable portion 15 on the first hooking portion 13 and at least one removable portion on the second hooking portion 14.

The attached figures illustrate, in a non-limiting way, a preferential embodiment of the safety device 12. Such device may however be of the known type as described in patent application no. WO2015/170203A1. Alternatively, the safety device may comprise a label (embodiment not illustrated) made of sheet material made at least partially of paper and/or plastic material: the label can be engaged outside the container following the first closing condition of the latter and in particular of the system 7. Still considering the first closing condition of the container 1 and prior to the first opening condition thereof, the label comprises at least one first constraining portion engaged with the closure system 7—in particular with the closure portion 9 of the tab 8—and at least one second constraining portion engaged with the lateral wall 4 of the storage and in particular with the wall that, in the closing condition of the system 7, directly faces and abuts with the engagement portion 10. Advantageously, the first and second constraining portions are glued outside the container 1.

The label further comprises at least one removable portion configured to be separated from at least one from said closure systems 7 and storage 2 following a first opening of the closure system 7 or in the event of an attempt to remove the label from the container 1. In more detail, the removable portion 15 represents a portion of the label configured to cause a breakage thereof in the event in which an attempt were made to remove the label from the container or an attempt to open the closure system 7 for the first time.

The label engaged to the outside of the container 1 defines an L-shaped profile; the first constraining portion is in contact with the second surface 9*b* of the closure portion 9 while the second constraining portion—joined as one piece to the first constraining portion—is in contact with the second surface 2*b* of the storage 2.

In one embodiment of the label, the latter may also comprise at least one projection borne by the removable portion: the projection emerges from the storage 2 and/or from the closure system 7 and is therefore perceivable to touch, for example when the hand touches the container 1.

The removable portion of the label, together with the projection, is exclusively engaged with said first and second constraining portions by means of weakening lines which form pre-cut weakened portions of the label. In other words, the removable portion (together with the projection) is not directly constrained to the container 1 but is only engaged with the first and second constraining portion.

The removable portion, together with the projection, is configured to be separated from the first and second constraining portion following the first opening of the closure system 7 or following an attempt to remove the label itself to provide evidence of tampering with the container 1.

In more detail, during the first opening of the system 7, the constraining portions are configured to remain engaged (glued) to the storage 2 and to the closure portion 9; the removable portion is not directly constrained to the storage 2 and to the system 7: the weakening lines present on the tab around the removable portion cause the breakage of the label and the separation of said removable portion from the respective constraining portions. As described above, the removable portion bears the projection which when separated from the label is no longer perceivable to touch: following the first opening of the container, the label can therefore provide evidence of tampering even to a blind person due to the perceived lack of projection.

B. Process of Making a Tamper-Evident Container

The subject matter of the present invention is also a process of making a container 1 in accordance with one or more of the attached claims and/or with the above description.

The process firstly envisages the provision of the storage 2 which as described above is made of sheet material, optionally paper material. In particular, such step envisages the provision of at least one sheet 51 comprising at least one first and one second portion 52, 54 interconnected by a central connection portion 53. The first sheet 51 further comprises at least one first and one second lateral connecting portions 55, 56. As can be seen for example from FIG. 16, the central connecting portion 53 is interposed between the first and the second portion 52, 54, the first portion 52 is interposed between the first lateral connecting portion 55 and the central connecting portion 53, while the second portion 54 is interposed between the second lateral connecting portion 56 and the central connecting portion 53. Each of said portions 52, 53, 54, 55, 56 comprises at least two opposite longitudinal edges and two opposite terminal edges: the portions 52, 54, the central connecting portion 53 and said lateral connecting portions 55, 56 are joined along the longitudinal edges and aligned along a single connecting direction.

In a preferential but non-limiting configuration of the invention, the first portion 52 of the first sheet 51 has a rectangular shape delimited perimetrally by a lower edge 52*a*, a first and second lateral edge 52*b*, 52*c* and an upper edge 52*d*. Likewise, the second portion 54 of the first sheet 51 has a rectangular shape delimited perimetrally by a lower edge 54*a*, a first and second lateral edge 54*b*, 54*c* and an upper edge 54*d*. Advantageously, the first and the second portion 52, 54 comprise a sheet substantially having the same shape and size. The central portion 53 and the lateral connecting portions 55, 56 also have a rectangular shape; such portions substantially have the same shape and/or size and are joined as one piece to the portions 52 and 54 of the first sheet at the lateral edges.

Figure 16:
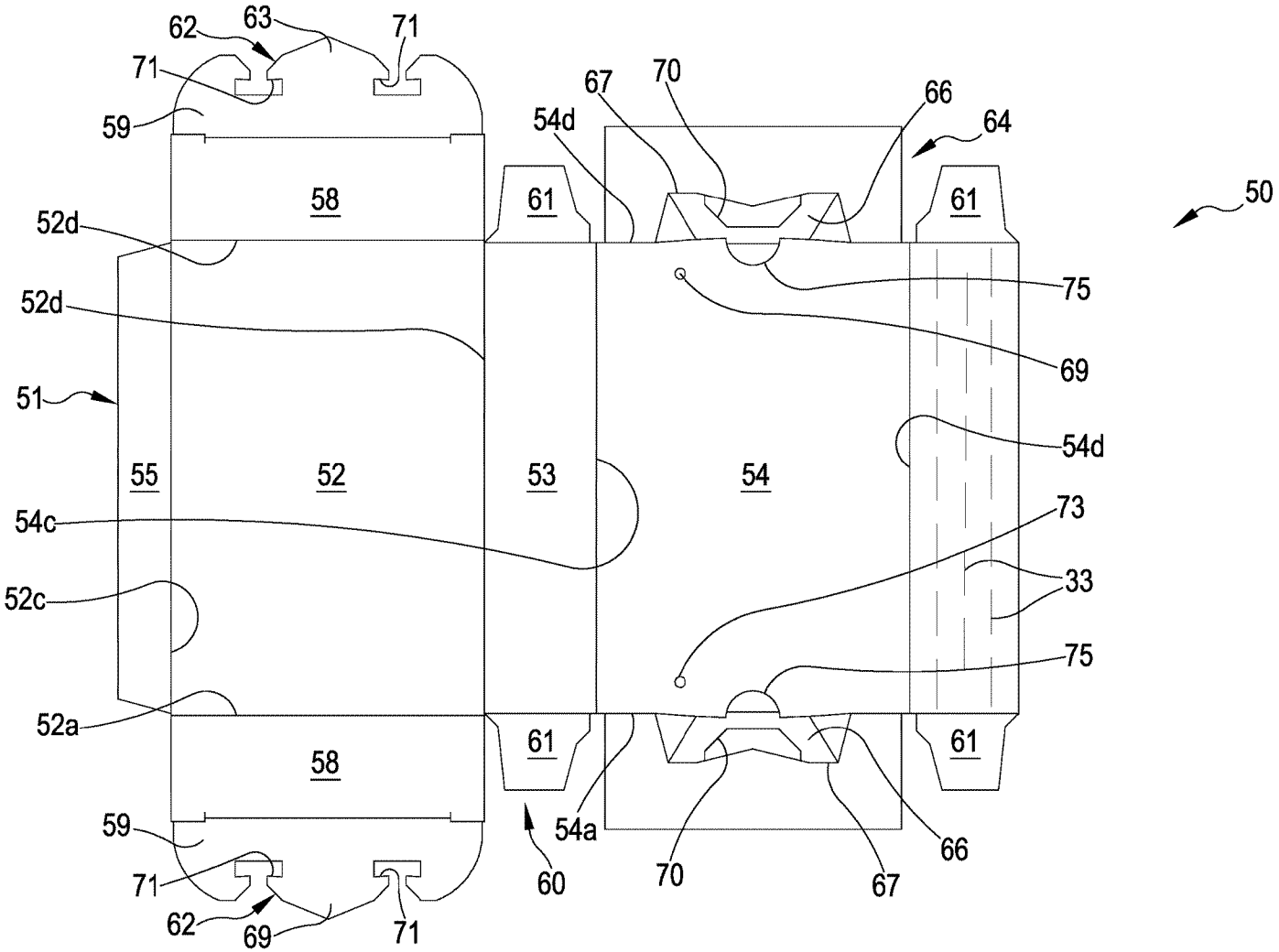
FIG. 16 schematically illustrates a flat semi-finished piece for making a container.
Figure 17:
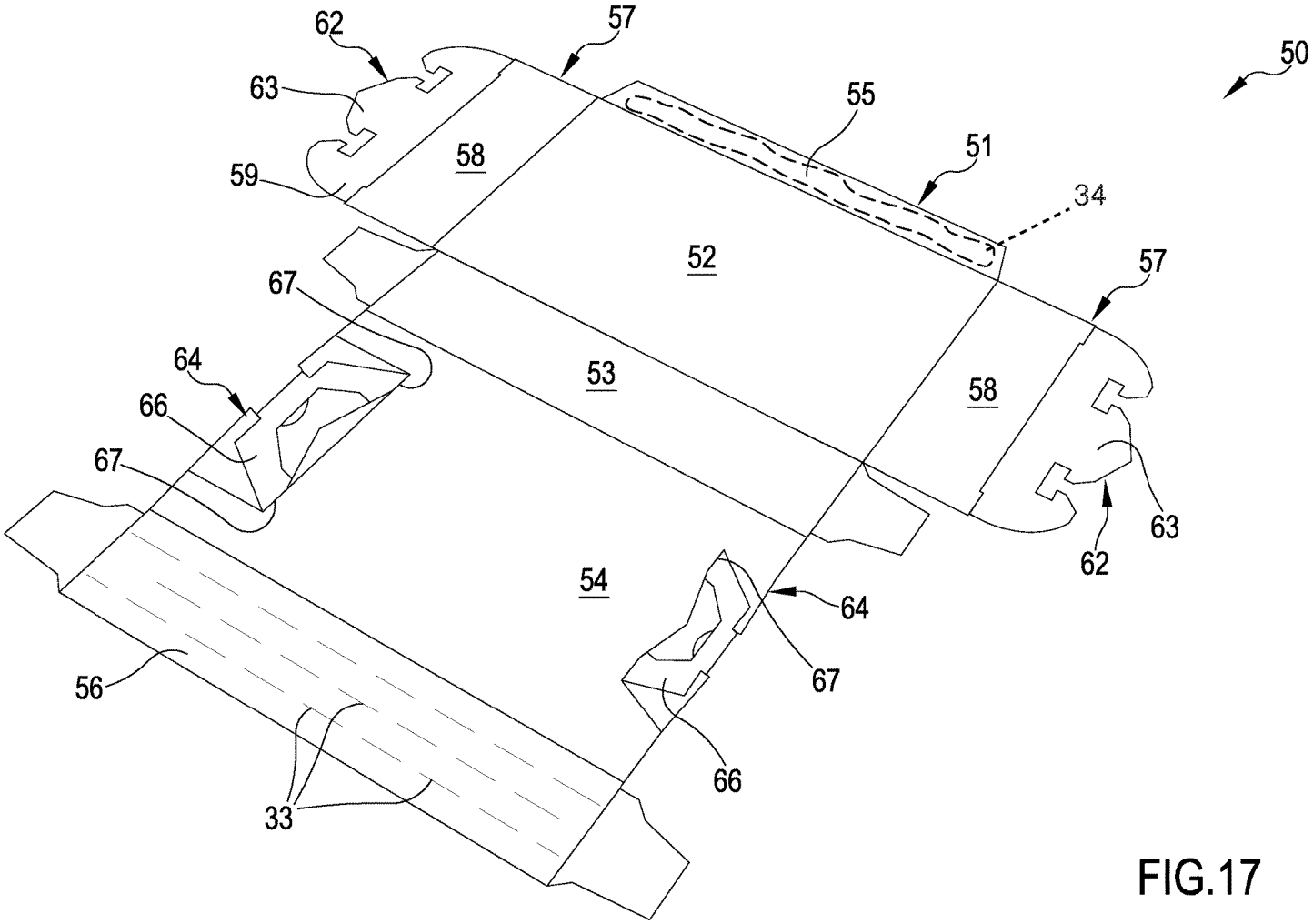
FIGS. 17 and 18 are schematic views of a process for making a container.

As can be seen in FIG. 16, the second lateral connecting portion comprises at least one notch 33, in particular a plurality of notches 33, configured for defining the weakening portion 30 of the storage 2. Such notches 33 are performed during the step of providing the first sheet 51.

Figure 18:
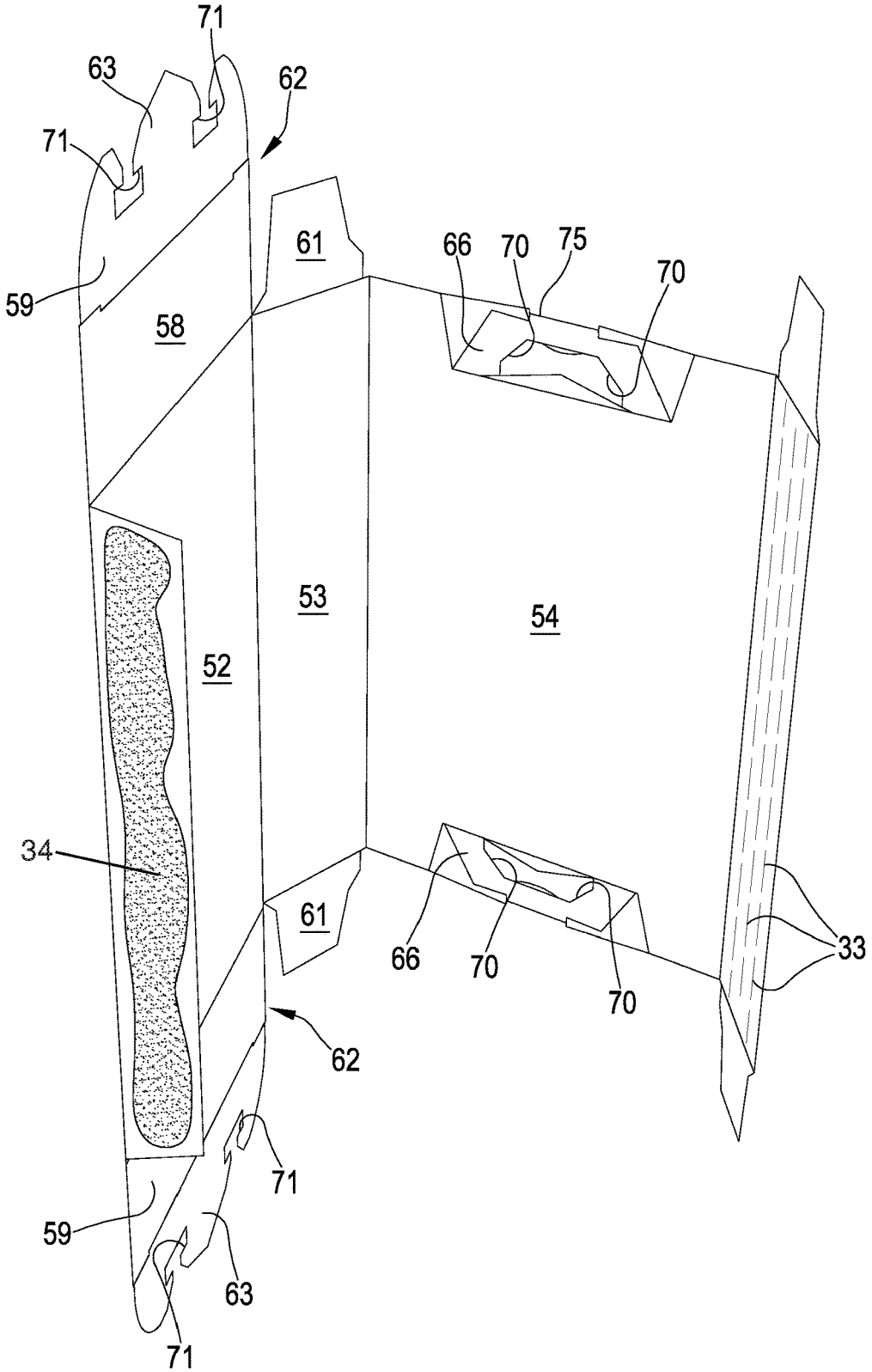

The step of providing the storage 2 envisages a step of folding the first sheet 51 at the lateral edges of the portions 52, 53, 54, 55 and 56 so that it is possible to join the lateral connecting portions 55, 56 which are adapted to define respectively the first and the second constraining portions 31 and 32 of the storage 2. As depicted for example in FIG. 18, the first sheet is wrapped on itself so as to be positioned in contact (overlapping) with the lateral connecting portions 55 and 56. In order to keep the storage 2 in the folded three-dimensional shape, the process may envisage, in a non-limiting way, the application of a predetermined quantity of glue, for example cold glue, on at least one of the longitudinal connecting portions 55, 56 adapted to be abutted against each other: the joining of said portions allows the storage 2 to be locked in the folded configuration. The attached figures illustrate, in a non-limiting way, a process that envisages the application of a predetermined quantity of glue only on the first longitudinal connecting portion 55. The possibility is not excluded of applying the glue on both portions 55 and 56.

It is useful to specify that the step of providing the first sheet 51 may envisage a crushing step which allows folding lines to be defined on the sheet itself coinciding with the longitudinal lateral edges of the portions of said first sheet 51. In fact, the folding steps of the portions of the first sheet take place precisely along the longitudinal lateral edge of said portions which are crushed in order to promote their movement (folding). The step of performing notches 33 may be take place at the same time as the crushing step.

The step of providing the first sheet 51 may also envisage a step of forming at least one through notch 69 thereon 51 arranged on the first and/or on the second portion 52, 54 and which is configured to define said control opening 24. The notch 69 is substantially performed at the lower and/or upper edge of at least one of said portions 52, 54. The step of providing the first sheet 51 also envisages at least one step of forming at least one through notch 75 thereon 51 (see for example FIG. 16) arranged on the first and/or on the second portion 52, 54 which is configured to define the break 27. The grove 75 is substantially performed at the lower and/or upper edge of at least one of said portions 52, 54. Advantageously although without limitation, the groove 75 is performed on the same portion of the sheet on which the notch 69 is defined and in particular above the latter. In particular, the through groove 75 is defined on at least one transverse edge of the first or second portion 52, 54 of the first sheet 51. The through groove 75 defines an open outline substantially having a C-, U- or V-shape. Advantageously, the first sheet 51 is entirely made of paper material, having a paper basis weight comprised between 100 and 500 g/m$^2$, in particular comprised between 300 and 400 g/m$^2$.

The step of providing the first sheet may envisage the cutting of a flat starting sheet, for example, made of paper material. During the cutting step of the flat starting sheet, at least one further cut is performed for defining at least one notch 33, the notch 69 and the through groove 75.

The process also envisages the provision of the closing system 7. This step envisages the provision of at least one second sheet 57, advantageously, joined as one piece to the first sheet 51, in particular at a terminal edge of the first and/or second portion 52, 54 of the first sheet 51 (FIGS. 13 and 25). The second sheet 57 comprises at least one first and one second portion 58, 59 joined together in one piece: the first portion 58 of the second sheet 57 is connected to the first sheet 51 so that said first portion 58 is interposed between the second portion 59 of the second sheet 57 and the first sheet 51. The attached figures illustrate a preferential but non-limiting configuration of the invention wherein the provision of two second sheets 57 engaged with the first sheet 51 and arranged opposite with respect to the latter is envisaged. The second sheet 57 is for example directly connected to the upper edge 52*d* and/or to the lower edge 52*a* of the portion 52 of the first sheet 51. FIG. 16 illustrates, by way of non-limiting example, an embodiment envisaging the formation of two sheets 57 respectively on the lower 52*a* and upper 52*d* edges of the portion 52. Advantageously, the second sheet 57 is joined as one piece with the first sheet, defining a single sheet only; in particular, the second sheet 57 is also made of paper material, in particular with a sheet of paper having substantially the same characteristics as the first sheet 51.

The step of providing the second sheet may be performed through cutting a flat starting sheet, for example made of paper material, in particular at the same time as cutting the starting sheet for making the first sheet.

The process further envisages folding steps of the first and the second portion 58, 59 of the second sheet 57 for forming the closure portion 9 and the engagement portion 10, respectively, of the closure system 7. The folding step of the second sheet is performed preferably but in a non-limiting way following the engagement of the portions 55 and 56 of the first sheet 51.

The step of providing the closure system 7 may also envisage a sub-step of providing at least one sheet 60 having at least one portion 61 connected to at least one central and/or lateral connecting portion of the first sheet 51 and emerging with respect to the latter from the same side from which the second sheet 57 emerges. Advantageously, the sheet 60 comprises four portions 61 joined in one piece to the first sheet 51. Two portions 61 are connected to the central portion 53 and emerging from the latter opposite each other along respective terminal edges (emerging from the first sheet 51 on the same side from which the second sheet 57 emerges).

Two further portions 61 are connected to the longitudinal connecting portion 55 or 56 and emerging from the latter opposite each other along respective terminal edges (emerging from the first sheet 51 on the same side from which the second sheet 57 emerges). Each portion 61 is made of flat sheet material, in particular paper sheet material, and has a substantially square or trapezoidal shape. Advantageously, the third sheet 60 is also made of paper material, in particular with a sheet of paper material having substantially the same characteristics as the first and the second sheet 51, 57.

The step of providing the sheet 60 may be performed through cutting a flat starting sheet, for example made of paper material, in particular at the same time as cutting the starting sheet for making the first and second sheet.

The process envisages the step of folding—in particular after folding the first sheet 51—the portion 61 of the sheet 60 towards the internal volume of the storage to form the support portion 11 of the container 1.

In a preferential but non-limiting embodiment of the invention, the process further envisages the provision of the safety device 12 which envisages at least the sub-step of providing a third sheet 62 comprising at least one portion 63 joined as one piece to the second portion 59 of the second sheet 57. The portion 63 of the third sheet 62 is also made of sheet material, particularly paper sheet material, and emerges longitudinally from the second sheet 57 on the opposite side to the first sheet 51: the portion 63 of the third sheet 62 is configured for defining the first hooking portion 13 of the container 1. The attached figures illustrate, by way of non-limiting example, a configuration of the third sheet 62 which is directly connected (emerging moving away) to the second portion 59 of the second sheet 57.

In more detail, the step of forming the portion 63 of the third sheet 62 envisages at least the following sub-steps:

- forming, as an extension to the second portion 59 of the second sheet 57, a flat sheet substantially parallel to the second sheet 57, the extension sheet emerging from the second portion 59 on the opposite side with respect to the first portion 59 of the second sheet 57;
- forming at least one undercut 71 adapted to define the first hooking portion 13 of the container 1.

The undercut 71 substantially defines on the fourth sheet a seat configured for defining the undercut 20 of the first hooking portion 13. Advantageously, the step of forming the extension envisages the formation of at least two undercuts 71 opposite each other with respect to the third sheet 62 itself and which are configured for defining the respective undercuts 20 of the first hooking portion 13. As described above, the third sheet 62 is also made of paper material, in particular with a sheet of paper material having substantially the same characteristics as the first, second and third sheet 51, 57, 60.

The provision of the safety device 12 further envisages at least the sub-step of providing a fourth sheet 64 comprising at least one portion 65 joined as one piece to the first sheet 51. In a non-limiting configuration of the invention, illustrated in FIGS. 13 and 25, the fourth sheet 64 emerges laterally from the first sheet 51 at the side of the portion 55: this latter portion is interposed between the fourth sheet 64 and the portion 52 of the first sheet 51. In this configuration, the process, during the step of forming the storage 2, envisages folding the portion 65 of the fourth sheet 64, defining said second hooking portion 14, straight after folding the longitudinal portion 55: in this way, following the subsequent folds of the portions 53, 54 and 56, the fourth sheet 64 is positioned inside the storage 2. The step of folding the portion 65 of the fourth sheet 64, defining said second hooking portion 14, can be performed before, during or after the formation of the storage 2. In any case, following the step of folding the portion 65, the latter is configured to be arranged in the internal volume 3 of the storage defining said hooking portion 14.

The portion 65 of the fourth sheet 64 is also made of sheet material, in particular paper sheet material. In more detail, the step of forming the portion 65 of the fourth sheet 64 envisages at least the following sub-steps:

- forming, as an extension to the first sheet 51, a flat sheet substantially parallel to the second sheet 57;
- forming on said sheet at least one undercut 70 adapted to define the second hooking portion 14 of the container 1, The undercut 70 substantially defines a seat adapted to house the undercut 71 of the third sheet 62; the undercut 70 is, in fact, configured for defining the undercut 16 of the second hooking portion 14. Advantageously, the step of forming the extension envisages the formation of at least two undercuts 70 opposite each other and which are configured for defining the respective undercuts 16 of the second hooking portion 14.

In a preferential but non-limiting embodiment of the invention, the first, second, third and fourth sheets 51, 57, 62, 64 are joined as one piece to form a single blank sheet 50 (condition illustrated in FIGS. 13 and 25): the blank sheet 50 is at least partially, in particular fully, made of paper sheet material; optionally the blank sheet 50 has a paper basis weight comprised between 100 and 500 g/m$^2$, in particular comprised between 300 and 400 g/m$^2$.

The process further envisages a step of forming on portion 63 and/or 65 respectively of the third and fourth sheet 62, 64 at least one further portion 66 joined as one piece to said portion 63, 65 through a weakening line 67: the further portion 66 defines the undercut 70 and/or 71 and is configured for defining the removable portion 15 of the container 1. This step of forming the further portion 66 substantially envisages a sub-step of crushing and/or incising the third and/or fourth sheet 62, 64 for forming on the latter a weakening line 67 (see for example 16) which is adapted to define a separable (tearable) portion of the sheet from the main body of the sheet. The attached figures illustrate a non-limiting configuration of the invention in which the further portion 66 is borne by the fourth sheet 64 so that, at the end of the crushing and/or incising steps and subsequent folding of the sheets, the removable portion 15 is borne by the second hooking portion 14 as illustrated in the attached figures showing the container 1. However, as described above, the removable portion 15 can be borne by the hooking portion 13 or by both portions 13, 14. The process envisages forming the same number of further portions 66 as the number of second sheets 57 present and therefore the number of closure systems 7 provided on the container 1. FIG. 16 illustrates a preferential but non-limiting configuration of the invention in which two third sheets 62 are provided, respectively joined as one piece to the two second sheets 57, for forming first hooking portions 13; there are therefore at least two further portions 66 borne by a single fourth sheet 64: the portions 66 are configured for defining two removable portions 15 which are adapted to cooperate with the two respective first hooking portions 13 of the third sheet 62.

Advantageously, the sheets are obtained starting from a single flat sheet, in particular made of paper material, which is sheared for defining the blank 50 comprising the sheets 51, 57, 60, 62 and 64 described above. The shearing step, as well as defining the outline of the blank, is configured for performing the crushing of the sheet for perimetrally delimiting the individual sheets, for example, defining the terminal connecting edges of the sheet and along which the folds must then be performed. The shearing step further allows the incising of the portions 52 and 54 for defining at least one of the following elements: the control opening 24, the groove 75, the undercuts 70 and/or 71.

During the shearing step the crushing and/or incising of the third and/or fourth sheet takes place simultaneously for defining the weakening line 67 (or the plurality of weakening lines 67) for forming the further portion 66.

The container 1 according to the present invention thanks to the presence of a structurally weakened overlapping zone 30 (presence of one or more notches 33) allows effective evidence to be provided of tampering having taken place in the event of an attempt to open the container by separating the first and second constraining portions 31, 32 which represent the (lateral) closing portions of the storage 2. In fact, in the event of an attempt to open the container 1 laterally, by acting on the lateral closure of the storage defined by the first and second constraining portion (31, 32), the visible constraining portion 32 of the container 1 would be damaged, which would therefore no longer be able to be engaged with the first portion 31 without it being visible that tampering with the container 1 had taken place. As, for example, depicted in FIG. 7, the notch 33 is configured for generating a tear in the second constraining portion 32 in the event of an attempt to separate the latter from the first constraining portion 31 for opening (e.g. laterally) the storage 2. The notches 33 therefore define a tamper-proof safety system of the container.

The container 1 may further be equipped, in a non-limiting way, with the safety device 12 active on each closure system 7 adapted to provide evidence of tampering with the container 1 following a first opening of the system 7; in this configuration (presence of the weakening portion on the overlapping zone of the storage and of the device 12), the container 1 has a safety system adapted to provide evidence of any tampering arranged at every possible access to the container 1.

The invention claimed is:

1. A tamper-evident container comprising:

at least one storage made of a sheet material that defines an internal volume, the storage having at least one passage opening delimited by a free edge, the passage opening being configured to put in communication the internal volume of the storage with an external environment, wherein the sheet material of the storage wraps at least partially on itself in order to form an overlapping zone comprising at least a first constraining portion and a second constraining portion engaged with each other, wherein the first constraining portion defines at least part of an internal surface of the storage and the second constraining portion delimits at least part of an external surface of the storage; and at least one closure system made of the sheet material engaged at the free edge, the closure system being movable with respect to the storage and being configured for defining at least one closing condition in which the closure system interdicts a communication between the internal volume of the storage and the external environment, the closure system being further configured for defining an opening condition in which the closure system enables the communication between the internal volume and the external environment, wherein at least one notch defining a weakening portion of said second constraining portion is defined on the second constraining portion.

2. The tamper-evident container of claim 1, wherein the second constraining portion of the storage is made of the sheet material and extends in thickness between a first surface and a second surface, and the notch extends in thickness between the first and the second surfaces of the second constraining portion.

3. The tamper-evident container of claim 1, wherein the notch passes through the second constraining portion.

4. The tamper-evident container of claim 1, wherein the storage comprises at least one lateral sheet wrapped at least partially on itself along a longitudinal axis and defining a tubular shape, wherein the lateral sheet forms the overlapping zone longitudinally extending along the longitudinal axis.

5. The tamper-evident container of claim 4, wherein the weakening portion of the second constraining portion of the overlapping zone has a predetermined longitudinal extension measured along the longitudinal axis of the lateral sheet, wherein a ratio of the predetermined longitudinal extension of the weakening portion to the longitudinal extension of the lateral sheet is greater than 0.3.

6. The tamper-evident container of claim 4, wherein the second constraining portion comprises a plurality of notches defined along the whole longitudinal extension of the overlapping zone.

7. The tamper-evident container of claim 4, wherein the tubular shape is along a cross-section normal to the longitudinal axis and defines a plurality of free edges at respective ends of longitudinal edges of the lateral sheet, each of the plurality of free edges delimits a passage opening configured to put in communication the internal volume of the storage with the external environment, wherein for each passage opening, the container comprises a respective closure system, wherein the weakening portion of the second constraining portion is defined between the longitudinal edges of the lateral sheet.

8. The tamper-evident container of claim 4, wherein the lateral sheet comprises a front wall and a rear wall facing and in parallel to each other, the front wall and rear wall being connected to each other by a first and a second connecting walls, the first connecting wall facing and being in parallel to the second connecting wall, the front wall being distanced from the rear wall by the first and the second connecting walls, the first and the second connecting walls being distanced from each other by the front and rear walls, wherein the closure system is directly connected to the rear wall of the storage, and the overlapping zone is defined on the first connecting wall.

9. The tamper-evident of claim 1, wherein the second constraining portion comprises a plurality of notches pass through a thickness of the second constraining portion.

10. The tamper-evident container of claim 1, wherein the second constraining portion of the overlapping zone is distinct from the closure system.

11. The tamper-evident container of claim 1, wherein the first and the second constraining portions are engaged to each other by at least one connector selected from the group consisting of:

one or more glue portions, and one or more portions of one or more adhesive materials, wherein at least part of the notch of the weakening portion is defined at the second constraining portion directly engaged to the first constraining portion.

12. The tamper-evident container of claim 11, wherein the connector extends along the whole extension of the weakening portion.

13. The tamper-evident container of claim 11, wherein at least part of the weakening portion directly contacts the connector.

14. The tamper-evident container of claim 11, wherein the adhesive material comprises a cold glue, wherein the notch is defined on a part of the second constraining portion that is glued with the cold glue.

15. The tamper-evident container of claim 1, wherein the second constraining portion comprises a plurality of notches pass through a thickness of the second constraining portion, and the second constraining portion being glued by cold glue to the first constraining portion, wherein the cold glue directly contacts the portion of the second constraining portion having the plurality of notches to the first constraining portion.

16. The tamper-evident container of claim 1 further comprising at least one safety device engaged with the storage and with a closure system of the at least one closure system, the safety device being made of the sheet material and comprising at least one removable part configured to be separable from at least one of the closure system and the storage following a first-time opening of the closure system to provide evidence of tampering of the container.

17. The tamper-evidence container of claim 16, wherein for each closure system, the tamper-evidence container has a respective safety device, and each closure system is separated from the overlapping zone of the storage.

18. The tamper-evidence container of claim 16, wherein the closure system comprises a tab having a closure portion engaged with the free edge of the storage, the tab being movable by rotation with respect to the free edge, the tab further having at least one engagement portion configured for inserting into the internal volume of the storage when the closure system is closed, and wherein the safety device comprises:

at least one first hooking part borne by the tab of the closure system, and at least one second hooking part engaged with the storage and configured for cooperating with the first hooking part, wherein the first and the second hooking parts are configured to stably engage with each other upon a first-time closing of the closure system, at least one part between the first and the second hooking parts bearing the removable part which is configured to be separable from the safety device following the first-time opening after a first-time closing of the closure system.

* * * * *